US009931731B2

(12) United States Patent
Sharmila et al.

(10) Patent No.: US 9,931,731 B2
(45) Date of Patent: Apr. 3, 2018

(54) COMPRESSED POLYMER IMPREGNATED BACKING MATERIAL ABRASIVE ARTICLES INCORPORATING SAME, AND PROCESSES OF MAKING AND USING

(71) Applicants: SAINT-GOBAIN ABRASIVES, INC., Worcester, MA (US); SAINT-GOBAIN ABRASIFS, Conflans-Sainte-Honorine (FR)

(72) Inventors: Muthukrishnan Sharmila, Chennai (IN); Adiseshaiah K. Sathyanarayanaiah, Chennai (IN); VelliamKattupudur Samiappan Naveen, Chennai (IN); Harish Gautham, Bangalore (IN); Shyam Prasad Komath, Chennai (IN)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 178 days.

(21) Appl. No.: 14/976,972

(22) Filed: Dec. 21, 2015

(65) Prior Publication Data

US 2016/0193716 A1 Jul. 7, 2016

(30) Foreign Application Priority Data

Dec. 23, 2014 (IN) ..... 6483/CHE/2014

(51) Int. Cl.
*C09K 3/14* (2006.01)
*B24D 3/00* (2006.01)

(52) U.S. Cl.
CPC ..... *B24D 3/001* (2013.01)

(58) Field of Classification Search
None
See application file for complete search history.

(56) References Cited

U.S. PATENT DOCUMENTS 3,058,819 A * 10/1962 Paulson ..... B24D 3/001 51/295
4,042,559 A * 8/1977 Abelson ..... B65G 53/523 51/298

(Continued)

FOREIGN PATENT DOCUMENTS

KR 200360927 Y1 9/2004
KR 100469222 B1 2/2005

(Continued)

OTHER PUBLICATIONS

International Search Report from PCT/US2015/067093 dated Mar. 24, 2016, 1 pg.

*Primary Examiner* — Jennifer A Smith
*Assistant Examiner* — Ross J Christie
(74) *Attorney, Agent, or Firm* — Abel Law Group, LLP; Joseph P Sullivan

(57) ABSTRACT

This invention relates to compressed composite backing materials (e.g., compressed polymer impregnated backing substrates) and coated abrasive articles that include such compressed composite backing materials. This invention also relates to methods of making and using said compressed composite backing materials and coated abrasive articles. The claimed processes and systems related to the use and manufacturing of coated abrasive articles are improved and cost effective.

18 Claims, 12 Drawing Sheets

(56) References Cited

U.S. PATENT DOCUMENTS

| | | | | | |
|---|---|---|---|---|---|
| 4,725,487 | A * | 2/1988 | Pemrick | B24D 11/02 | 442/148 |
| 5,178,646 | A * | 1/1993 | Barber, Jr. | B24D 3/28 | 51/293 |
| 5,284,702 | A | 2/1994 | Umemoto et al. | | |
| 5,549,719 | A * | 8/1996 | Lee | B24D 3/344 | 51/295 |
| 5,582,625 | A | 12/1996 | Wright et al. | | |
| 5,785,784 | A * | 7/1998 | Chesley | A44B 18/0049 | 51/297 |
| 5,919,549 | A * | 7/1999 | Van | B24D 3/004 | 51/298 |
| 2002/0014040 | A1* | 2/2002 | Vincent | B24D 3/28 | 51/298 |
| 2009/0149624 | A1* | 6/2009 | Pullichola | B24D 3/28 | 528/155 |
| 2009/0181260 | A1* | 7/2009 | Verma | C08G 8/28 | 51/295 |
| 2009/0205259 | A1* | 8/2009 | Burzynski | C09K 3/1409 | 51/295 |
| 2010/0159805 | A1* | 6/2010 | Goldsmith | B24B 7/182 | 51/298 |
| 2011/0162286 | A1 | 7/2011 | Yang et al. | | |
| 2012/0009850 | A1 | 1/2012 | Hsu et al. | | |
| 2013/0111823 | A1 | 5/2013 | Klenner et al. | | |

FOREIGN PATENT DOCUMENTS

| | | | |
|---|---|---|---|
| WO | WO-2006127728 | A1 | 11/2006 |
| WO | WO-2016106212 | A1 | 6/2016 |

* cited by examiner

COMPRESSED POLYMER IMPREGNATED BACKING MATERIAL ABRASIVE ARTICLES INCORPORATING SAME, AND PROCESSES OF MAKING AND USING

CROSS-REFERENCE TO RELATED APPLICATION

The application claims priority under 35 U.S.C. §119(a)-(d) to, and incorporates herein by reference in its entirety for all purposes, Indian application 6483/CHE/2014, filed Dec. 23, 2014, entitled "COMPRESSED POLYMER IMPREGNATED BACKING MATERIAL, ABRASIVE ARTICLES INCORPORATING SAME, AND PROCESSES OF MAKING AND USING", to Muthukrishnan SHARMILA et al., which application is incorporated by reference herein in its entirety.

FIELD OF THE DISCLOSURE

The present invention relates generally to polymer impregnated backing materials, including compressed polymer impregnated backing materials (also referred to herein as "compressed composite backing materials"), abrasive articles including the same, and methods of making and using the compressed polymer impregnated backing materials and abrasive articles.

BACKGROUND

Vulcanized fiber, sometimes also referred to as "vulcanized fibre" or "fish paper", has long been in use in the abrasive arts and refers to a leather-like or horn-like material generally formed from cellulose by compressing layers of chemically treated (for example, with metallic chlorides) cellulose derived from paper, paper pulp, rayon, or cloth. Vulcanized fiber is hydrophilic in nature and prone to absorbing moisture.

Abrasive articles that employ vulcanized fiber as a substrate material suffer from a well-recognized problem of a lack of dimensional stability (commonly called shape distortion, with specific examples of shape distortion being "curling" and "cupping") caused by changes in environmental moisture content (e.g., humidity). The lack of dimensional stability can detrimentally impact abrasive performance and cause premature end of life of an abrasive product (e.g., delamination, excessive warping of the abrasive article). Various approaches have been attempted to solve the problems related to the use of vulcanized fiber substrates but all suffer from certain drawbacks. Therefore, there continues to be a demand for improved abrasive articles.

BRIEF DESCRIPTION OF THE DRAWINGS

The present disclosure can be better understood, and its numerous features and advantages made apparent to those skilled in the art by referencing the accompanying drawings.

The use of the same reference symbols in different drawings indicates similar or identical items.

DETAILED DESCRIPTION

Figure 1:
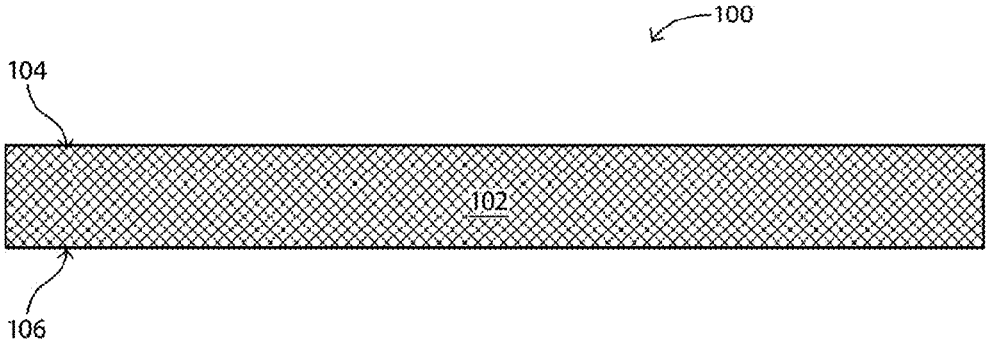
FIG. 1 is an illustration of a cross sectional view of an embodiment of a compressed composite backing material.

The following description, in combination with the figures, is provided to assist in understanding the teachings disclosed herein. The following discussion will focus on specific implementations and embodiments of the teachings. This discussion is provided to assist in describing the teachings and should not be interpreted as a limitation on the scope or applicability of the teachings.

The term "averaged," when referring to a value, is intended to mean an average, a geometric mean, or a median value. As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but can include other features not expressly listed or inherent to such process, method, article, or apparatus. As used herein, the phrase "consists essentially of" or "consisting essentially of" means that the subject that the phrase describes does not include any other components that substantially affect the property of the subject.

Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

Further, references to values stated in ranges include each and every value within that range. When the terms "about" or "approximately" precede a numerical value, such as when describing a numerical range, it is intended that the exact numerical value is also included. For example, a numerical range beginning at "about 25" is intended to also include a range that begins at exactly 25. Moreover, it will be appreciated that references to values stated as "at least about," "greater than," "less than," or "not greater than" can include a range of any minimum or maximum value noted therein.

As used herein, the phrase "average particle diameter" can be reference to an average, mean, or median particle diameter, also commonly referred to in the art as D50.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and can be found in textbooks and other sources within the coated abrasive arts.

FIG. 1 shows an illustration of a cross section of a compressed composite backing material 100 embodiment. A compressed composite backing material is comprised of a compressed backing substrate 102; such as a nonwoven fabric, a woven fabric, a paper, a fibre reinforced paper, or combinations thereof, that is impregnated with a polymer composition. The compressed composite backing material has a first side 104 and a second side 106.

Figure 2:
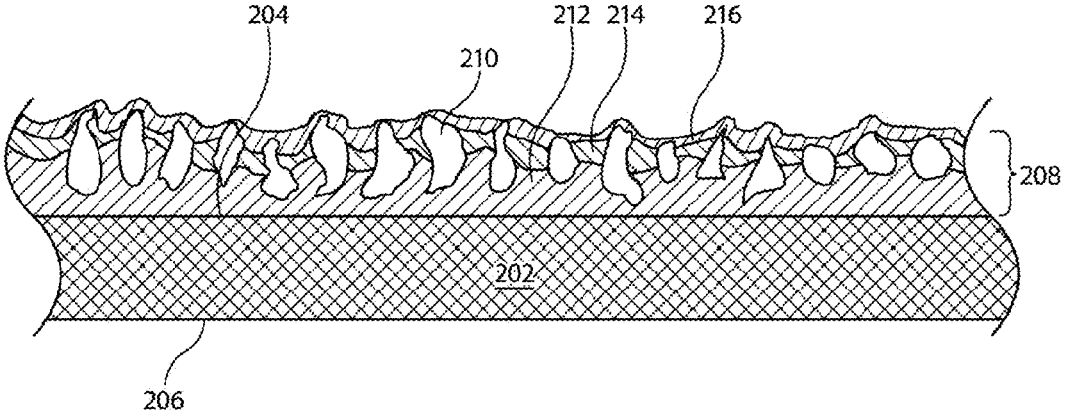
FIG. 2 is an illustration of a cross-sectional view of an embodiment of a coated abrasive that includes a compressed composite backing material.

FIG. 2 shows an illustration of a cross section of a coated abrasive article 200 embodiment that includes a compressed composite backing material 202. The compressed composite backing material is comprised of a compressed backing substrate impregnated with a polymer composition (e.g. a nonwoven fabric). An abrasive layer 208 is disposed on the first side 204 of the compressed composite backing material 202 opposite the second side 206 of the compressed composite backing material. The abrasive layer 208 comprises abrasive particles 210 disposed on or dispersed in a binder composition 212 (e.g., a make coat or an abrasive slurry coat). An optional size coat 214 is disposed on the abrasive layer. An optional supersize coat 216 is disposed on the size coat.

Figure 3:
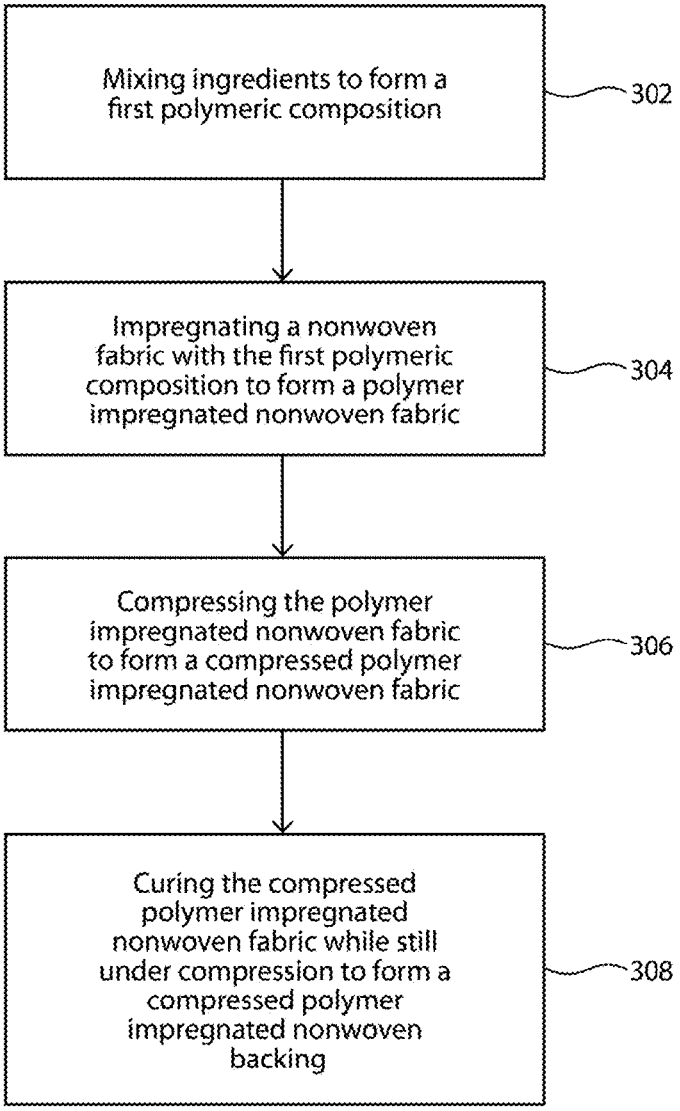
FIG. 3 is an illustration of a flowchart of an embodiment of a method of making a compressed composite backing material.

FIG. 3 is an illustration of a flowchart of an embodiment of a method 300 of making a compressed composite backing material according to an embodiment. Step 302 includes mixing of ingredients to form a polymeric composition (also referred to herein as a "saturant composition" or "saturant"). In an embodiment, the ingredients comprise an epoxy composition, or a mixture of phenolic resin and water. Step 304 includes impregnating (also called herein "saturating") a backing substrate (e.g., nonwoven fabric) with the polymeric composition to form a polymer impregnated backing substrate. In an embodiment, the backing substrate is a nonwoven fabric, such as a spun lace fabric or a stitch bonded fabric. Step 306 comprises compressing the polymer impregnated backing substrate to form a compressed polymer impregnated backing substrate. Step 308 comprises curing, at least partially to fully, the compressed polymer impregnated backing substrate (i.e., curing at least partially to fully the polymeric composition that permeates the compressed backing substrate) to form a compressed composite backing material. In an embodiment, Step 306 and 308 can occur at the same time.

Figure 4:
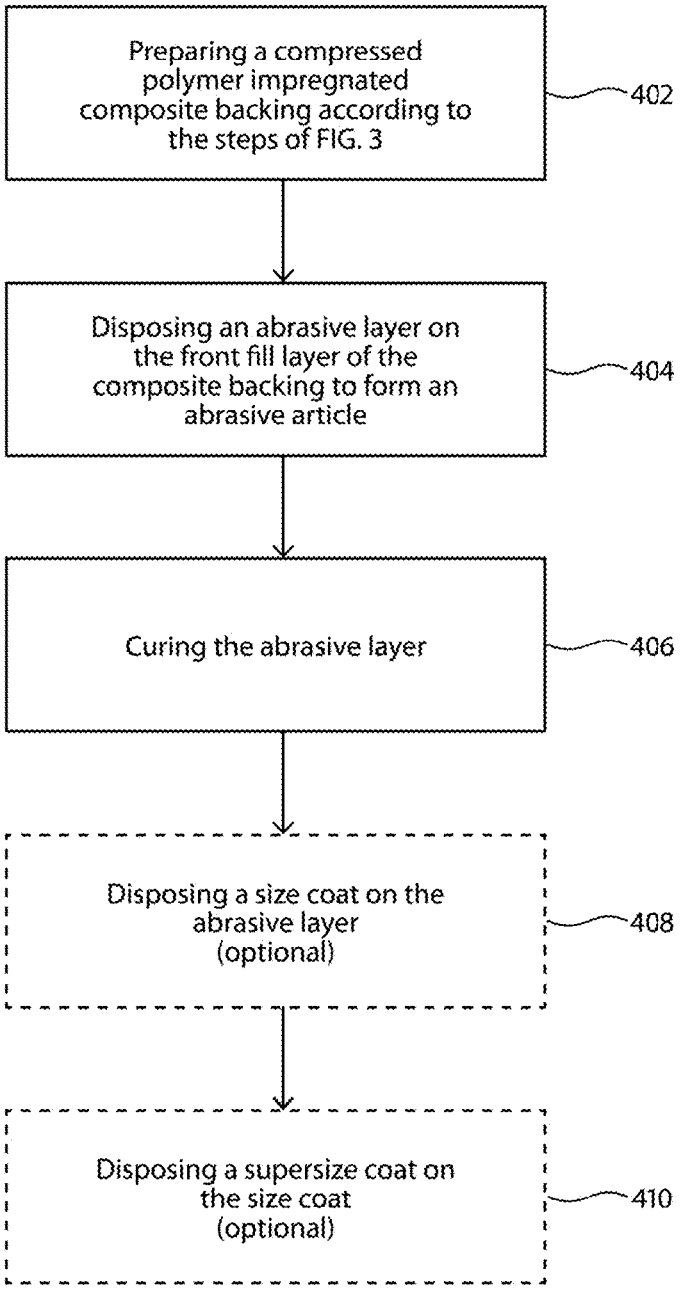
FIG. 4 is flowchart of an embodiment of a method of making an abrasive article that includes a compressed composite backing material.

FIG. 4 is an illustration of a flowchart of an embodiment of a method 400 of making a coated abrasive that includes a compressed composite backing material according to an embodiment. Step 402 includes preparing a compressed composite backing material according to the steps of the method described above in FIG. 3. Step 404 includes disposing an abrasive layer on the compressed composite backing material to form an abrasive article. Step 406 includes curing, at least partially to fully, the abrasive layer. Optionally, step 408 includes disposing a size coat on the abrasive layer. Optionally, step 410 includes disposing a super size coat on the size coat.

Figure 5:
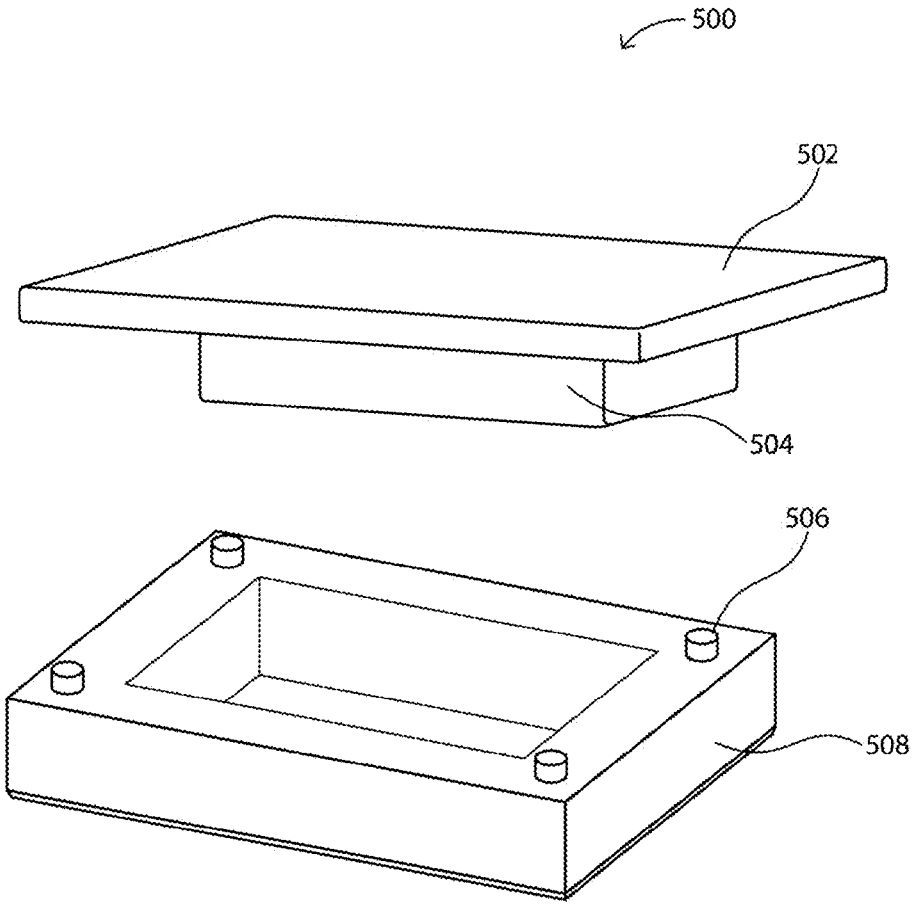
FIG. 5 is an illustration of an embodiment of a compression mold useful for making a compressed composite backing material.

FIG. 5 is an illustration of is an illustration of an embodiment of a compression mold useful for making a compressed composite backing material. In an embodiment, the compression mold can have the form of a box and comprises a lid 502 and a mold body 508 that the lid fits on. The lid 502 includes a compression component 504 for applying pressure to a backing substrate (not shown) that is placed within an open recess 510 of the mold body 508. The open recess 510 is sized to contain the backing substrate and a desired amount of polymer composition (not shown) for saturating the backing substrate. The mold body can include spacers 506 used to adjust the height of the lid 502 and the pressure applied by compression component 504.

Compressed Composite Backing Material

A compressed composite backing material (also referred to herein as a compressed polymer impreganted backing material) comprises a compressed polymer impregnated backing substrate. The compressed composite backing material possesses beneficial physical properties that contribute to unexpected beneficial and superior abrasive performance of abrasive articles that include the compressed composite backing material.

A compressed polymer impregnated backing material comprises a backing substrate that has been impregnated (i.e., saturated with) with a polymeric composition (also called herein a "saturating" composition or a "saturant" composition), compressed, and cured while under compression. Suitable backing substrates include nonwoven fabrics, woven fabrics, paper, fibre reinforced paper, and combinations thereof.

The nonwoven fabric can be an organic material, an inorganic material, a natural material, a synthetic material, or a combination thereof. The nonwoven fabric can be flexible, rigid, or a combination thereof. The nonwoven fabric can comprise a single type of fiber or a plurality of different types of fibers. The nonwoven fabric can comprise polyester, cotton, nylon, silk, cellulose, cotton, viscose, jute, polyamide, polyamine, aramide, poly-cotton, rayon, or combinations thereof. Specific synthetics can comprise Kevlar, Nomex, and combinations thereof. The fabric can comprise virgin fibers or recycled fibers. The nonwoven fabric can be a finished fabric, or an unfinished fabric (i.e. "grey fabric"), or a combination thereof. In a particular embodiment, the nonwoven fabric is a polyester fabric.

The nonwoven fabric can be a spun lace fabric, a chemically bonded fabric, a thermally bonded fabric, a needle punched fabric, a stitch-bonded fabric, or combinations thereof. A spunlace fabric is a hydroentangled fabric. A spunlace fabric can incorporate dry-laid webs as precursors or wet-laid webs as precursors. A stitch bonded fabric can be a maliwatt fabric, a malivies fabric, a malimo fabric, a malipol fabric, a voltex fabric, a kunit fabric, a multiknit fabric, or combinations thereof, and the like. In an embodiment, the nonwoven fabric is a spunlace fabric, a stitch bonded fabric, or a combination thereof. In an embodiment, the nonwoven fabric is a spunlace fabric. In another embodiment, the nonwoven fabric is a stitch bonded fabric.

The nonwoven fabric can comprise a single web (also called a batt) or a plurality of webs (batts). In an embodiment, the number of webs of the nonwoven fabric can be not less than 1 web, such as not less than 2 webs, not less than 3 webs, or not less than 4 webs. In another embodiment, the number of webs of the stitch bonded fabric can be not greater than 10 webs, such as not greater than 9 webs, not greater than 8 webs, not greater than 7 webs, or not greater than 6 webs. The number of webs of the nonwoven fabric can be within a range comprising any pair of the previous upper and lower limits. In a particular embodiment, the number of webs of the nonwoven fabric is in the range of 1 to 10 webs, such as 2 to 8 webs, or 2 to 7 webs. In a particular embodiment, the nonwoven fabric is a spunlace fabric that can comprise 1 to 4 webs, such as 4 webs, 3 webs, 2 webs, or even 1 web. In another specific embodiment, the nonwoven fabric is a stitch bonded fabric that can comprise 1 to 3 webs, such a 3 webs, 2 webs, or even 1 web.

The stitch bonded fabric can have a particular type of stitch bond. The stitch bonded fabric can be a warp stitch bonded fabric, a weft stitch bonded fabric, or a combination thereof. In an embodiment, the stitch bonded fabric is warp stitch bonded fabric. The stitch bonded fabric can include any known stitch or combination of stitches in the stitch bonded fabric art. In a particular embodiment, the stitch bonded fabric includes a chain stitch.

The nonwoven fabric and have a particular mass per unit area, such as g/m2 (GSM), commonly called the "weight" of the fabric. In an embodiment, the weight of the nonwoven fabric can be not less than 50 GSM, not less than 100 GSM, not less than 200 GSM, not less than 300 GSM, or not less than 350 GSM. In another embodiment, the weight of the nonwoven fabric can be not greater than 600 GSM, not greater than 500 GSM, not greater than 450 GSM, not greater than 400 GSM, or not greater than 390 GSM. The amount of weight of the nonwoven fabric can be within a range comprising any pair of the previous upper and lower limits. In a particular embodiment, the amount of weight of the nonwoven fabric can be in the range of not less than 50 GSM to not greater than 600 GSM, such as not less than 100 GSM to not greater than 500 GSM, not less than 200 GSM to not greater than 400 GSM, such as not less than 300 GSM to not greater than 390 GSM. In a particular embodiment, the nonwoven fabric can comprise a weight in a range of not less than 50 GSM to not greater than 500 GSM, such as not less than 75 GSM to not greater than 425 GSM, such as not less than 100 GSM to not greater than 400 GSM.

The polymer impregnated nonwoven fabric can comprise any combination of the above features. In a specific embodiment, the polymer impregnated nonwoven fabric comprises two webs of spunlace polyester fabric, each web having a weight in a range of 130 to 170 g/m2. In another embodiment, the polymer impregnated nonwoven fabric comprises a warp stitch bonded polyester fabric having three webs and a total weight in a range of 360 to 400 g/m2.

Woven fabric can be an organic material, an inorganic material, a natural material, a synthetic material, or a combination thereof. The woven fabric can be flexible, rigid, or a combination thereof. The woven fabric can comprise a single type of fiber or a plurality of different types of fibers. The woven fabric can comprise polyester, cotton, nylon, silk, cellulose, cotton, viscose, jute, polyamide, polyamine, aramide, poly-cotton, rayon, or combinations thereof. Specific synthetics can comprise Kevlar, Nomex, and combinations thereof. The fabric can comprise virgin fibers or recycled fibers. The woven fabric can be a finished fabric, or an unfinished fabric (i.e. "grey fabric"), or a combination thereof. In a particular embodiment, the woven fabric is a cotton fabric, a polyester fabric, a nylon fabric, or combinations thereof.

The woven fabric can comprise a single layer or a plurality of layers. In an embodiment, the woven fabric has a single layer. In another embodiment, the number of layers of the woven fabric can be not less than 1 layer, such as not less than 2 layers, not less than 3 layers, or not less than 4 layers. In another embodiment, the number of layers of the woven fabric can be not greater than 10 layers, such as not greater than 9 layers, not greater than 8 layers, not greater than 7 layers, or not greater than 6 layers. The number of layers of the woven fabric can be within a range comprising any pair of the previous upper and lower limits. In a particular embodiment, the number of layers of the woven fabric is in the range of 1 to 10 layers, such as 2 to 8 layers, or 2 to 7 layers. In a particular embodiment, the woven fabric can comprise 1 to 4 layers, such as 4 layers, 3 layers, 2 layers, or even 1 layer. In another specific embodiment, the woven fabric can comprise 1 to 3 layers, such a 3 layers, 2 layers, or even 1 layer.

The woven fabric can have a particular mass per unit area, such as g/m2 (GSM), commonly called the "weight" of the fabric. In an embodiment, the weight of the woven fabric can be not less than 50 GSM, not less than 100 GSM, not less than 200 GSM, not less than 300 GSM, or not less than 350 GSM. In another embodiment, the weight of the woven fabric can be not greater than 950 GSM, not greater than 650 GSM, not greater than 550 GSM, not greater than 450 GSM, or not greater than 390 GSM. The amount of weight of the woven fabric can be within a range comprising any pair of the previous upper and lower limits. In a particular embodiment, the amount of weight of the woven fabric can be in the range of not less than 50 GSM to not greater than 950 GSM, such as not less than 100 GSM to not greater than 550 GSM, not less than 200 GSM to not greater than 450 GSM, such as not less than 300 GSM to not greater than 390 GSM. In a particular embodiment, the woven fabric can comprise a weight in a range of not less than 50 GSM to not greater than 950 GSM, such as not less than 75 GSM to not greater than 650 GSM, such as not less than 100 GSM to not greater than 450 GSM.

The polymer impregnated woven fabric can comprise any combination of the above features.

The paper can be of a particular weight and fiber content, including paper that is reinforced with particular types of fiber, such as natural or synthetic fibers, including vulcanized fibre.

Polymeric Composition

As stated above, the backing substrate is impregnated with a polymeric composition and compressed. The polymer impregnated backing substrate can be described in terms of the polymeric composition when cured, partially cured, or fully cured.

A polymeric composition can be formed of a single polymer or a blend of polymers. The polymeric composition can comprise an epoxy polymer, a phenolic polymer, a resorcinol polymer, a melamine polymer, a urea polymer, or combinations thereof.

Epoxy Composition

An epoxy composition comprises an epoxy resin, a suitable hardener, and optionally, an accelerator. An epoxy resin can comprise an aromatic epoxy, an aliphatic epoxy, an amine epoxy, a polyamide epoxy, an amidoamine epoxy, a phenolic epoxy, a novolac epoxy, a siloxane epoxy, a coal tar epoxy, a water-based epoxy, an epoxy ester, or combinations thereof. Aromatic epoxies components include one or more epoxy groups and one or more aromatic rings. An example aromatic epoxy includes epoxy derived from a polyphenol, e.g., from bisphenols, such as bisphenol A (4,4'-isopropylidenediphenol), bisphenol F (bis[4-hydroxyphenyl]methane), bisphenol S (4,4'-sulfonyldiphenol), 4,4'-cyclohexylidenebisphenol, 4,4'-biphenol, 4,4'-(9-fluorenylidene) diphenol, or any combination thereof. The bisphenol can be alkoxylated (e.g., ethoxylated or propoxylated) or halogenated (e.g., brominated). Examples of bisphenol epoxies include bisphenol diglycidyl ethers, such as diglycidyl ether of Bisphenol A or Bisphenol F. A further example of an aromatic epoxy includes triphenylolmethane triglycidyl ether, 1,1,1-tris(p-hydroxyphenyl)ethane triglycidyl ether, or an aromatic epoxy derived from a monophenol, e.g., from resorcinol (for example, resorcin diglycidyl ether) or hydroquinone (for example, hydroquinone diglycidyl ether). Another example is nonylphenyl glycidyl ether. In addition, an example of an aromatic epoxy includes epoxy novolac, for example, phenol epoxy novolac and cresol epoxy novolac. Aliphatic epoxy components have one or more epoxy groups and are free of aromatic rings. The polymer precursor for the matrix polymer can include one or more aliphatic epoxies. An example of an aliphatic epoxy includes glycidyl ether of C2-C30 alkyl; 1,2 epoxy of C3-C30 alkyl; mono or multi glycidyl ether of an aliphatic alcohol or polyol such as 1,4-butanediol, neopentyl glycol, cyclohexane dimethanol, dibromo neopentyl glycol, trimethylol propane, polytetramethylene oxide, polyethylene oxide, polypropylene oxide, glycerol, and alkoxylated aliphatic alcohols; or polyols. In one embodiment, the aliphatic epoxy includes one or more cycloaliphatic ring structures. For example, the aliphatic epoxy can have one or more cyclohexene oxide structures, for example, two cyclohexene oxide structures. An example of an aliphatic epoxy comprising a ring structure includes hydrogenated bisphenol A diglycidyl ether, hydrogenated bisphenol F diglycidyl ether, hydrogenated bisphenol S diglycidyl ether, bis(4-hydroxycyclohexyl)methane diglycidyl ether, 2,2-bis(4-hydroxycyclohexyl)propane diglycidyl ether, 3,4-epoxycyclohexylmethyl-3,4-epoxycyclohexanecarboxylate, 3,4-epoxy-6-methylcyclohexylmethyl-3,4-epoxy-6-methylcyclohexanecarboxylate, di(3,4 epoxycyclohexylmethyl)hexanedioate, di(3,4-epoxy-6-methylcyclohexylmethyl)hexanedioate, ethylenebis(3,4-epoxycyclohexanecarboxylate), ethanedioldi(3,4-epoxycyclohexylmethyl)ether, or 2-(3,4-epoxycyclohexyl-5,5-spiro-3,4-epoxy)cyclohexane-1,3-dioxane.

In addition to or instead of one or more cationically curable components, the binder formulation can include one or more free radical curable components, e.g., one or more free radical polymerizable components having one or more ethylenically unsaturated groups, such as (meth)acrylate (i.e., acrylate or methacrylate) functional components.

An example of a monofunctional ethylenically unsaturated component includes acrylamide, N,N-dimethylacrylamide, (meth)acryloylmorpholine, 7-amino-3,7-dimethyloctyl (meth)acrylate, isobutoxymethyl(meth)acrylamide, isobornyloxyethyl (meth)acrylate, isobornyl (meth)acrylate, 2-ethylhexyl (meth)acrylate, ethyldiethylene glycol (meth) acrylate, t-octyl (meth)acrylamide, diacetone (meth)acrylamide, dimethylaminoethyl (meth)acrylate, diethylaminoethyl (meth)acrylate, lauryl (meth)acrylate, dicyclopentadiene (meth)acrylate, dicyclopentenyloxyethyl (meth)acrylate, dicyclopentenyl (meth)acrylate, N,N-dimethyl(meth)acrylamidetetrachlorophenyl (meth)acrylate, 2-tetrachlorophenoxyethyl (meth)acrylate, tetrahydrofurfuryl (meth)acrylate, tetrabromophenyl (meth)acrylate, 2-tetrabromophenoxyethyl (meth)acrylate, 2-trichlorophenoxyethyl (meth)acrylate, tribromophenyl (meth)acrylate, 2-tribromophenoxyethyl (meth)acrylate, 2-hydroxyethyl (meth)acrylate, 2-hydroxypropyl (meth)acrylate, vinylcaprolactam, N-vinylpyrrolidone, phenoxyethyl (meth)acrylate, butoxyethyl (meth)acrylate, pentachlorophenyl (meth) acrylate, pentabromophenyl (meth)acrylate, polyethylene glycol mono(meth)acrylate, polypropylene glycol mono (meth)acrylate, bornyl (meth)acrylate, methyltriethylene diglycol (meth)acrylate, or any combination thereof.

An example of the polyfunctional ethylenically unsaturated component includes ethylene glycol di(meth)acrylate, dicyclopentenyl di(meth)acrylate, triethylene glycol diacrylate, tetraethylene glycol di(meth)acrylate, tricyclodecanediyldimethylene di(meth)acrylate, trimethylolpropane tri (meth)acrylate, ethoxylated trimethylolpropane tri(meth) acrylate, propoxylated trimethylolpropane tri(meth)acrylate, tripropylene glycol di(meth)acrylate, neopentyl glycol di(meth)acrylate, both-terminal (meth)acrylic acid adduct of bisphenol A diglycidyl ether, 1,4-butanediol di(meth)acrylate, 1,6-hexanediol di(meth)acrylate, polyethylene glycol di(meth)acrylate, (meth)acrylate-functional pentaerythritol derivatives (e.g., pentaerythritol tri(meth)acrylate, pentaerythritol tetra(meth)acrylate, dipentaerythritol hexa(meth)acrylate, dipentaerythritol penta(meth)acrylate, or dipentaerythritol tetra(meth)acrylate), ditrimethylolpropane tetra(meth)acrylate, ethoxylated bisphenol A di(meth)acrylate, propoxylated bisphenol A di(meth)acrylate, ethoxylated hydrogenated bisphenol A di(meth)acrylate, propoxylated-modified hydrogenated bisphenol A di(meth)acrylate, ethoxylated bisphenol F di(meth)acrylate, or any combination thereof.

In a particular embodiment, the epoxy composition comprises a phenolic epoxy, and an anhydride hardener. Suitable phenolic epoxy compositions and associated hardeners are available under the trade name Araldite®, available from Ciba Specialty Chemicals.

In an embodiment, the uncured polymeric composition can comprise at least 50% epoxy composition, at least 60% epoxy composition, at least 70% epoxy composition, at least 80% epoxy composition, at least 90% epoxy composition, at least 95% epoxy composition, at least 99% epoxy composition, or about 100% epoxy composition.

Optionally, from about 0.1 wt % to about 5 wt % of additives can also be included in the polymeric composition. If one or more additives are included, the amount of the other ingredients can be adjusted so that the total amounts of the ingredients in the polymeric composition adds up to 100 wt %. The total epoxy composition can comprise a single epoxy resin, or a plurality of epoxy resins, such as from one to five epoxy resins.

Phenolic Polymer Composition

The phenolic polymer, melamine polymer, or urea polymer can comprise a single prepolymer resin or a blend of resins. Phenolic polymers can comprise phenol formaldehyde resole resins. Resole resins are generally made using alkali hydroxides with a formaldehyde to phenol ratio of about 1.0 to 3.0 at a pH of 7 to 13. In an embodiment the polymeric composition comprises a phenolic resole resin. In another embodiment, the polymeric composition comprises a mixture of a plurality of phenolic resole resins. In an embodiment, the polymeric composition can comprise from two to five phenolic resole resins. In a specific embodiment, the polymeric composition comprises a mixture of a first phenolic resole resin and a second phenolic resole resin.

Resole resins can be classified by a number of features, such as the formaldehyde to phenol ratio (F/P ratio) prior to reaction, free formaldehyde content (FFC) of the polymer after reaction, free phenol content (FPC) after reaction, gel time at a specific temperature, and the water tolerance of the resin. In an embodiment, the F/P ratio can be in a range of 0.95 to 2.5, such as 0.95 to 1.1, or 1.2 to 1.5, or 1.6 to 1.8, or 1.9 to 2.2, or a combination thereof. In an embodiment, the FFC can be in a range of 0.02% to 3.3% by weight of the resin, such as about 0.02% to 0.09%, or 0.2% to 0.45%, or 0.5% to 0.8%, or 1.0% to 1.3%, or 2.5% to 3%, or combinations thereof. In an embodiment, the FPC can be in a range of 2% to 5%, or 4% to 7%, or 12% to 15%, or 16% to 20%, or combinations thereof. In an embodiment, the gel time at 121° C. can be in range of 5 minutes to 30 minutes, such as 7-11 minutes, 8-12 minutes, 9-10 minutes, 10-12 minutes, 18-22 minutes, 19-26 minutes, or combinations thereof. In an embodiment, the water tolerance is in a range of 100% to 600%, such as 100 to 300%, 100 to 350%, 150 to 300%, 150 to 350%, 400 to 480%, 400 to 550%, 430 to 500%, or combinations thereof. In an embodiment, the polymeric composition comprises a phenolic resole resin, also referred to herein as a high temperature (HT) phenolic resin having an F/P ratio in a range of 1.2 to 1.5, a gel time at 121° C. in a range of 18-22 minutes; and a water tolerance in a range of 400 to 480%. In another embodiment, the polymeric composition comprises a phenolic resole resin, also referred to herein as a low temperature (LT) phenolic resin, having an F/P ratio in a range of 1.6 to 1.8, a gel time at 121° C. in a range of 10-12 minutes; and a water tolerance in a range of 430 to 500%. In another embodiment the polymeric composition comprises a phenolic resole resin, also referred to herein as "CGF2" phenolic resin, having an F/P ratio in a range of 1.9 to 2.2, a gel time at 121° C. in a range of 7-11 minutes; and a water tolerance in a range of 150 to 300%. In yet another embodiment the polymeric composition comprises a phenolic resole resin, also referred to herein as "BM11" phenolic resin, having an F/P ratio in a range of 1.6 to 1.8, a gel time at 121° C. in a range of 8-12 minutes; and a water tolerance in a range of 150 to 300%.

In an embodiment, the uncured polymeric composition can comprise:

70 wt % to 100 wt % of total phenolic resin; and 0 wt % to 30 wt % water, wherein the percentages are based on a total weight of the polymeric composition and all the percentages of the ingredients add up to 100 wt %. Optionally, from about 0.1 wt % to about 5 wt % of additives can also be included in the polymeric composition. If one or more additives are included, the amount of the other ingredients can be adjusted so that the total amounts of the ingredients in the polymeric composition adds up to 100 wt %. The total phenolic resin can comprise a single phenolic resin, or a plurality of phenolic resins, such as from two to five phenolic resins.

In another embodiment, the uncured polymeric composition can comprise:

35 wt % to 55 wt % of a first phenolic resin;

35 wt % to 55 wt % of a second phenolic resin; and 0 wt % to 30 wt % water, wherein the percentages are based on a total weight of the polymeric composition and all the percentages of the ingredients add up to 100 wt %. Optionally, from about 0.1 wt % to about 5 wt % of additives can also be included in the polymeric composition. If one or more additives are included, the amount of the other ingredients can be adjusted so that the total amounts of the ingredients in the polymeric composition adds up to 100 wt %. In a particular embodiment, the first phenolic resin is a high temperature (HT) phenolic resin having an F/P ratio in a range of 1.2 to 1.5, a gel time at 121° C. in a range of 18-22 minutes; and a water tolerance in a range of 400 to 480%. In a particular embodiment, the second phenolic resin is a low temperature (LT) phenolic resin, having an F/P ratio in a range of 1.6 to 1.8, a gel time at 121° C. in a range of 10-12 minutes; and a water tolerance in a range of 430 to 500%.

In another embodiment, the uncured polymeric composition can comprise:

40 wt % to 50 wt % of a first phenolic resin;

40 wt % to 50 wt % of a second phenolic resin and 0 wt % to 20 wt % water, wherein the percentages are based on a total weight of the polymeric composition and all the percentages of the ingredients add up to 100 wt %. In a particular embodiment, the first phenolic resin is a high temperature (HT) phenolic resin having an F/P ratio in a range of 1.2 to 1.5, a gel time at 121° C. in a range of 18-22 minutes; and a water tolerance in a range of 400 to 480%. In a particular embodiment, the second phenolic resin is a low temperature (LT) phenolic resin, having an F/P ratio in a range of 1.6 to 1.8, a gel time at 121° C. in a range of 10-12 minutes; and a water tolerance in a range of 430 to 500%.

Alternatively, the polymer impregnated backing substrate can be described with respect to a cured composition. In an embodiment, a cured polymeric composition can comprise: 95 wt % to 100 wt % of total phenolic resin, wherein the percentages are based on a total weight of the polymeric composition and all the percentages of the ingredients add up to 100 wt %. Optionally, from about 0.1 wt % to about 5 wt % of additives can also be included in the polymeric composition. If one or more additives are included, the amount of the other ingredients can be adjusted so that the total amounts of the ingredients in the polymeric composition adds up to 100 wt %. The total phenolic resin can comprise a single phenolic resin, or a plurality of phenolic resins, such as from two to five phenolic resins.

In another embodiment, the cured polymeric composition can comprise:

40 wt % to 60 wt % of a first phenolic resin; and 40 wt % to 60 wt % of a second phenolic resin, wherein the percentages are based on a total weight of the polymeric composition and all the percentages of the ingredients add up to 100 wt %. Optionally, from about 0.1 wt % to about 5 wt % of additives can also be added to the polymeric composition. If one or more additives are included, the amount of the other ingredients can be adjusted so that the total amounts of the ingredients in the polymeric composition adds up to 100 wt %. In a particular embodiment, the first phenolic resin is a high temperature (HT) phenolic resin having an F/P ratio in a range of 1.2 to 1.5, a gel time at 121° C. in a range of 18-22 minutes; and a water tolerance in a range of 400 to 480%. In a particular embodiment, the second phenolic resin is a low temperature (LT) phenolic resin, having an F/P ratio in a range of 1.6 to 1.8, a gel time at 121° C. in a range of 10-12 minutes; and a water tolerance in a range of 430 to 500%.

Alternatively, the polymeric composition can be expressed as a ratio of the first phenolic resole resin and the second phenolic resole resin. In an embodiment, the first phenolic resole resin and the second phenolic resole resin are present in a ratio (first resin:second resin) ranging from 1:9 to 9:1, such as from 1:2 to 2:1; from 1:1.5 to 1.5:1; from 1:1.25 to 1.25:1; or about 1:1.

It will be appreciated that the polymeric composition can be distributed uniformly or non-uniformly throughout the backing substrate. In an embodiment, the polymeric composition is uniformly dispersed throughout the backing substrate.

Amount of Impregnation (Saturation)—Add-on Weight

The amount of polymeric composition that impregnates (i.e., saturates) the backing substrate (i.e, the amount of polymeric composition that adheres to and/or is absorbed by the backing substrate) is also known as the "add-on" weight of the polymeric composition. The amount of saturation can be expressed as "wet" add-on weight, which is the weight of the uncured polymeric composition and can include water. Alternatively, the amount of saturation can be expressed a "dry" add-on weight, which is the weight of the cured polymeric composition and does not include water. The amount of add-on weight, whether wet add-on weight or dry add-on weight, can be expressed as a percentage of the original weight of the backing material. For example, if the backing substrate weighs: 100 g/m$^2$ prior to impregnation; 150 g/m$^2$ after impregnation (uncured); and 125 g/m$^2$ after curing, then the impregnated backing substrate would be considered 50 wt % saturated "wet" and 25 wt % saturated "dry". Alternatively, the amount of impregnation can be expressed as the mass of the add-on weight of the polymeric composition. For example, if the backing substrate weighs: 100 g/m$^2$ prior to saturation; weighs 150 g/m$^2$ after saturation (uncured), and 125 g/m$^2$ after curing, then the amount of saturation would be expressed as 50 g/m$^2$ of wet add-on weight and 25 g/m$^2$ of dry add-on weight of polymeric composition.

The dry add-on weight of the polymeric composition to the backing substrate can be in a particular range. In an embodiment, the dry add-on weight of the polymeric composition can be not less than 200 g/m2 (GSM), such as not less than 225 GSM, not less than 250 GSM, not less than 275 GSM, not less than 300 GSM, not less than 325 GSM, not less than 350 GSM, not less than 375 GSM, not less than 400 GSM, or not less than 425 GSM. In another embodiment, the dry add-on weight of the backing substrate can be not greater than 1000 GSM, such as not greater than 800 GSM, not greater than 725 GSM, not greater than 650 GSM, such as not greater than 625 GSM, not greater than 600 GSM, not greater than 575 GSM, not greater than 550 GSM, not greater than 525 GSM, not greater than 500 GSM, or not greater than 475 GSM. The dry add-on weight of the backing substrate can be within a range comprising any pair of the previous upper and lower limits. In a particular embodiment, the dry add-on weight of the backing substrate can be in a range of not less than 200 GSM to not greater than 1000 GSM, such as 250 to 600 GSM, such as 300 GSM to 550 GSM, such as 400 GSM to 500 GSM, or 425 GSM to 475 GSM.

The dry add-on weight of the polymeric composition can be a percentage of the weight of the unsaturated backing substrate. In an embodiment, the dry add-on weight of the polymeric composition can be not less than 50 wt %, such as not less than about 55 wt %, not less than about 60 wt %, not less than about 65 wt %, not less than about 70 wt %, not less than about 75 wt %, not less than about 80 wt %, not less than about 85 wt %, not less than about 90 wt %, or not less than about 95 wt %. In another embodiment, the dry add-on weight of the backing substrate can be not greater than 200 wt %, such as not greater than 190 wt %, not greater than 180 wt %, not greater than 170 wt %, not greater than 160 wt %, not greater than 150 wt %, not greater than 140 wt %, not greater than 135 wt %, not greater than 130 wt %, not greater than 125 wt %, or not greater than 120 wt %. The dry add-on weight of the polymeric composition can be within a range comprising any pair of the previous upper and lower limits. In a particular embodiment, the dry add-on weight of the polymeric composition can be in a range of not less than 50 wt % to not greater than 200 wt %, such as 75 wt % to 175 wt %, such as 100 wt % to 150 wt %, or 110 wt % to 140 wt %.

Alternatively, the polymer impregnated backing substrate can be described by the ratio of the weight of the backing substrate ($Weight_{backsub}$) to the dry add-on weight of the polymeric composition ($Weight_{polycom}$). In an embodiment, the ratio of $Weight_{backsub}$:$Weight_{polycom}$ can be in a range from 1:9 to 9:1, such as from 1:2 to 2:1; from 1:1.5 to 1.5:1; from 1:1.25 to 1.25:1; or about 1:1. In a particular embodiment, the ratio of $Weight_{backsub}$:$Weight_{polycom}$ is in a range from 1.0:1.5 to 1.0:3.0.

Compressed Composite Backing Material

The compressed composite backing material can be described on a percent weight basis of the compressed nonwoven backing material and, the cured polymeric composition. In an embodiment, a completed compressed composite backing material can comprise:

20 wt % to 60 wt % compressed backing substrate; and 40 wt % to 80 wt % cured polymeric composition; wherein the percentages are based on the total weight of the compressed composite backing material and all the percentages of the components add up to 100 wt %.

Beneficial Properties of a Compressed Composite Backing Material

The fully cured compressed composite backing material possesses physical properties that are surprisingly beneficial and that contribute to superior abrasive performance of an abrasive article that includes the compressed composite backing material.

Tensile strength in the machine direction (M/D) can be measured using an Instron 5982 with a 2 kN load cell. The composite backing material samples had a total sample length of 200 mm, a sample width of 25 mm, a gauge length of 127 mm, and were tested at a deformation rate of 300 mm/min. The compressed polymer impregnated backing substrate can have a particular tensile strength in the Machine Direction (M/D). In an embodiment, the tensile strength of the compressed polymer impregnated backing substrate in the M/D can be not less than 1 kgf/25 mm, not less than 5 kgf/25 mm, not less than 10 kgf/25 mm, not less than 15 kgf/25 mm, not less than 20 kgf/25 mm, or not less than 25 kgf/25 mm. In another embodiment, the tensile strength of the compressed polymer impregnated backing substrate in the M/D can be not greater than 150 kgf/25 mm, not greater than 140 kgf/25 mm, not greater than 130 kgf/25 mm, not greater than 130 kgf/25 mm, not greater than 120 kgf/25 mm, not greater than 110 kgf/25 mm, not greater than 100 kgf/25 mm, not greater than 750 kgf/25 mm, not greater than 60 kgf/25 mm, not greater than 50 kgf/25 mm, or not greater than 40 kgf/25 mm. The tensile strength of the compressed polymer impregnated backing substrate can be within a range comprising any pair of the previous upper and lower limits. In a particular embodiment, the tensile strength of the compressed polymer impregnated backing substrate in the M/D can be in a range of not less than 1 kgf/25 mm to not greater than 150 kgf/25 mm, such as not less than 75 kgf/25 mm to not greater than 150 kgf/25 mm, not less than 85 kgf/25 mm to not greater than 140 kgf/25 mm, or not less than 95 kgf/25 mm to not greater than 130 kgf/25 mm. In another specific embodiment, the tensile strength of the compressed polymer impregnated backing substrate in the M/D can be in a range of not less than 1 kgf/25 mm to not greater than 75 kgf/25 mm, such as not less than 15 kgf/25 mm to not greater than 65 kgf/25 mm, not less than 20 kgf/25 mm to not greater than 60 kgf/25 mm, or not less than 25 kgf/25 mm to not greater than 50 kgf/25 mm.

Tensile strength in the cross-direction (C/D) can be measured using an Instron 5982 with a 2 kN load cell. The compressed polymer impregnated backing substrate can have a particular tensile strength in the Cross Direction (C/D). In an embodiment, the tensile strength of the compressed polymer impregnated backing substrate in the C/D can be not less than 1 kgf/25 mm, not less than 5 kgf/25 mm, not less than 10 kgf/25 mm, or not less than 15 kgf/25 mm. In another embodiment, the tensile strength of the compressed polymer impregnated backing substrate in the C/D can be not greater than 100 kgf/25 mm, not greater than 95 kgf/25 mm, not greater than 90 kgf/25 mm, not greater than 85 kgf/25 mm, not greater than 80 kgf/25 mm, not greater than 75 kgf/25 mm, not greater than 70 kgf/25 mm, not greater than 65 kgf/25 mm, not greater than 60 kgf/25 mm, not greater than 55 kgf/25 mm, not greater than 50 kgf/25 mm, or not greater than 40 kgf/25 mm. The tensile strength of the compressed polymer impregnated backing substrate can be within a range comprising any pair of the previous upper and lower limits. In a particular embodiment, the tensile strength of the backing substrate in the C/D can be in a range of not less than 1 kgf/25 mm to not greater than 85 kgf/25 mm, such as not less than 5 kgf/25 mm to not greater than 80 kgf/25 mm, such as not less than 10 kgf/25 mm to not greater than 75 kgf/25 mm, not less than 15 kgf/25 mm to not greater than 70 kgf/25 mm, not less than 20 kgf/25 mm to not greater than 65 kgf/25 mm, or not less than 25 kgf/25 mm to not greater than 50 kgf/25 mm. In another particular embodiment, the tensile strength of the compressed polymer impregnated backing substrate in the C/D can be in a range of not less than 1 kgf/25 mm to not greater than 100 kgf/25 mm, such as not less than 50 kgf/25 mm to not greater than 100 kgf/25 mm, such as not less than 60 kgf/25 mm to not greater than 100 kgf/25 mm, not less than 70 kgf/25 mm to not less than 100 kgf/25 mm, or not less than 75 kgf/25 mm to not greater than 100 kgf/25 mm.

The compressed polymer impregnated backing substrate can have a particular tensile strength in the M/D and in the C/D such that the tensile strength in the M/D and tensile strength in the C/D have a particular relationship to each other. In an embodiment, the tensile strength in the M/D is greater than the tensile strength in the C/D. In another embodiment, the tensile in the M/D is less than the tensile strength in the C/D. In another embodiment, the tensile strength in the M/D is approximately the same as the tensile strength in the C/D. In an embodiment, the tensile strength in the M/D and in the C/D can both be greater than a particular minimum value. In an embodiment, the tensile strength of the compressed polymer impregnated backing substrate in both the M/D and in the C/D can be not less than 1 kgf/25 mm, not less than 5 kgf/25 mm, not less than 10 kgf/25 mm, not less than 15 kgf/25 mm, not less than 25 kgf/25 mm, or not less than 30 kgf/25 mm. In another embodiment, the tensile strength of the backing substrate in both the M/D and in the C/D can be not greater than 150 kgf/25 mm, or not greater than 145 kgf/25 mm. The tensile strength of the compressed polymer impregnated backing substrate in both the M/D and in the C/D can be within a range comprising any pair of the previous upper and lower limits. In a particular embodiment, the tensile strength of the backing substrate in both the M/D and in the C/D can be in a range of not less than 1 kgf/25 mm to not greater than 150 kgf/25 mm, such as not less than 25 kgf/25 mm to not greater than 100 kgf/25 mm.

Flexural Modulus in the machine direction (M/D) can be measured using an Instron 5966 with a 10 KN load cell. The compressed composite backing material samples had a total sample length of 10 cm, a sample width of 1 inch mm, a gauge length of 127 mm, and were tested at a deformation rate of 1 mm/min (flexural grip used: three point bending), with the test based on ASTM D-790. In an embodiment, the flexural modulus in the machine direction for the composite backing material is in a range of about 0.8 GPa to 7 GPa, such as 0.9 GPa to 6 GPa, 1 GPa to 5 GPa, 1.1 GPa to 4 GPa, 1.2 GPa to 3.5 GPa, or 1.3 GPa to 3 GPa. The flexural modulus in the machine direction can be within a range comprising any pair of the previous upper and lower limits.

Flexural Modulus in the cross direction (C/D) can be measured using an Instron 5966 with a 10 KN load cell. The compressed composite backing material samples had a total sample length of 10 cm, a sample width of 1 inch mm, a gauge length of 127 mm, and were tested at a deformation rate of 1 mm/min (flexural grip used: three point bending), with the test based on ASTM D-790. In an embodiment, the flexural modulus in the cross direction for the composite backing material is in a range of about 0.2 GPa to 5 GPa, such as 0.3 GPa to 4 GPa, 0.4 GPa to 3 GPa, 0.5 GPa to 2.5 GPa, 0.6 GPa to 2 GPa, or 0.7 GPa to 1.5 GPa. The flexural modulus in the cross direction can be within a range comprising any pair of the previous upper and lower limits.

The compressed polymer impregnated backing substrate can have a particular thickness. In an embodiment, the thickness of the compressed polymer impregnated backing substrate can be not less than 0.2 mm, such as not less than 0.4 mm, not less than 0.5 mm, not less than 0.6 mm, not less than 0.7 mm, not less than 0.8 mm, or not less than 0.9 mm. In another embodiment, the thickness of the compressed polymer impregnated backing substrate can be not greater than 4 mm, such as not greater than 3 mm, not greater than 2 mm, not greater than 1.8 mm, not greater than 1.6 mm, not greater than 1.4 mm, or not greater than 1.2 mm. The thickness of the compressed polymer impregnated backing substrate can be within a range comprising any pair of the previous upper and lower limits. In a particular embodiment, the thickness of the compressed polymer impregnated backing substrate can be in a range of not less than 0.2 mm to not greater than 4 mm, such as not less than 0.5 mm to not greater than 3 mm, not less than 0.8 mm to not greater than 2 mm, or not less than 0.9 mm to not greater than 1.8 mm.

The compressed composite backing material, and abrasive article embodiments that include the compressed composite backing material, can have a particular moisture resistance and dimensional stability under certain temperature and relative humidity conditions. Applicants have discovered that the compressed composite backing material embodiments, and abrasive article embodiments that include the compressed composite backing material embodiments, have surprisingly beneficial moisture resistance and dimensional stability (i.e., weight stability and resistance to changes in dimension, such as resistance to warping, curling, and cupping) as measured under certain temperature and relative humidity conditions.

In another embodiment, abrasive articles placed in a climate chamber at a temperature of 35° C. and 85% relative humidity (RH) for 2.5 hours, can have a % weight gain of less than 2.25%, such as less than less than 2%, less than 1%, or even less than 0.5%. Ideally, an abrasive article can have no weight gain (i.e., a gain of 0%), however, typically an abrasive disc will have some weight gain greater than zero percent, such as greater than 0.1%, greater than 0.2%, or greater than 0.3%. The weight gain of the abrasive article at 35° C. and 85% RH can be in a range comprising any pair of the previous upper and lower limits. In a particular embodiment, the weight gain of the abrasive article at 35° C. and 85% RH is in a range of 0.1% to 2.25%, such as 0.2% to 2%. (See FIG. 16)

In an embodiment, abrasive articles placed in a climate chamber at a temperature of 35° C. and 85% relative humidity (RH) for 2.5 hours can have a "three-point dimensional stability" determined by selecting three points on the surface of the abrasive disc: point "L" at the left edge of the disc; point "M" at the middle of the abrasive disc near the edge of the center hole of the disc; and point "R" at the right edge of the disc (See FIGS. 13A-15B) and recording their vertical distance while the disc is laying flat prior to being placed in the climate chamber and after being placed in the climate chamber for the specified period of time. The difference in vertical distance for the selected points can be used to calculate the change in dimension as a percent difference for each point. In an embodiment, the dimensional stability is a function of all three points. In an embodiment, an abrasive article can have a three-point dimensional stability at 35° C. and 85% RH where all three points have a % change in dimension of less than 75%, such as less than 70%, less than 65%, less than 60%, less than 55%, less than 50%, less than 45%, less than 40%, less than 35%, less than 30%, or even less than 25%. Ideally, an abrasive article can have no change in three-point dimensional stability (i.e., a percent change of 0%), however, typically an abrasive article will have a change of three-point dimensional stability at 35° C. and 85% RH for all three points greater than zero percent for each point, such as greater than 0.1%, greater than 1%, greater than 2%, greater than 3%, greater than 5%, greater than 8%, greater than 10%, greater than 12%, greater than 14%, or greater than 15%. The three-point dimensional stability at 35° C. and 85% RH for all three points can be in a range comprising any pair of the previous upper and lower limits. In a particular embodiment, an abrasive article can have a three-point dimensional stability at 35° C. and 85% RH where the % difference in dimension for all three points is in a range of 0.1% to 60%, such as 1% to 50%, such as 1% to 40%, such as 3% to 30%, such as 5% to 20%. (See FIG. 17)

Method of Making a Compressed Composite Backing Material

Mixing a Polymeric Composition

A polymeric composition can comprise a polymeric composition as described above. The ingredients of the polymeric composition are thoroughly mixed together. Mixing can be conducted using high shear conditions, moderate shear conditions, low shear conditions, or combinations thereof. Typically, mixing occurs until the ingredients are thoroughly mixed.

During mixing of the polymeric composition, the ingredients can be added to the polymeric composition one by one, in batches, or all at once. Typically the ingredients are added one by one to the polymeric composition. If the ingredients are added one by one or in batches, the polymeric composition can be agitated for a period of time until the ingredient has sufficiently mixed into the polymeric composition. Typical agitation times range from about 1 minute to about 2 hours, depending on the ingredient or ingredients being added to the polymeric composition.

The temperature of the polymeric composition can be adjusted if desired during mixing. The temperature of the polymeric composition during mixing can be in a range of about 15° C. to about 45° C., such as about 20° C. to about 25° C. The pH of the polymeric composition can be adjusted during mixing. The pH can be adjusted by the addition of an acid, a base, a buffer solution, or a combination thereof if desired. In an embodiment, the pH of the polymeric composition is typically basic, but can be close to neutral, such as in a range of about 7 pH to about 13 pH.

Water can be added to the polymeric composition in an amount to adjust or control the viscosity of the polymeric composition as desired. The viscosity of the polymeric composition can be monitored as it is being prepared. In an embodiment, the viscosity of the polymeric composition is adjusted to be within a particular range. In an embodiment, the viscosity of the polymeric composition is in a range of about 10 cps to about 300 cps, such as about 50 cps to about 250 cps, or about 75 cps to about 200 cps based on the addition of water to the polymeric composition.

Saturating the Backing Substrate

A suitable backing substrate, such as described above, can be saturated (also referred to herein as being "impregnated") with polymeric composition by any suitable manner that applies a sufficient amount of polymeric composition so that the backing substrate becomes thoroughly soaked with the polymeric composition. In an embodiment, saturation can be accomplished by dipping, spraying, submerging, coating, or washing the backing substrate with or in the polymeric composition, or combinations thereof. The saturation can occur as a single step or multiple steps, such as multiple dipping steps or multiple spraying steps of the backing substrate with the polymeric composition, or combinations thereof. The saturation can be done as a continuous or batch process. In a specific embodiment, the backing substrate is dipped into a polymeric composition to form a polymer impregnated backing substrate.

Compressing the Saturated Backing Substrate

The saturated backing substrate is compressed. The compression can be accomplished in a single step or multiple steps. The compression can be done as a continuous or batch process. Compression of the saturated backing substrate is accomplished in a manner so that the backing substrate remains saturated even while being compressed and remaining under compression. Compression can be accomplished by compressing the polymer impregnated backing substrate in a mold, a hydraulic press, rollers, or a combination thereof. In a specific embodiment, the compression step is accomplished using a suitable mold, such as shown in FIG. 5.

The compression step can be accomplished under a constant or variable pressure. In an embodiment, the pressure applied to the polymer impregnated backing substrate is in a range of at least 25 lb/m2 to not greater than 500 lb/m2. In a specific embodiment, the compression step is accomplished using a mold having a weighted lid that applies a constant or variable pressure to the saturated backing substrate contained within the mold. In a specific embodiment, spacers (see FIG. 5) are used to adjust the height of the weighted lid, thus adjusting the pressure the lid applies to the saturated backing substrate.

Curing the Compressed Saturated Backing Substrate

While the polymer impregnated backing substrate is still under compression the curing, partially to fully, occurs to form a completed compressed composite backing material (i.e., a cured compressed polymer impregnated backing substrate). Curing can be conducted in a single step or multiple steps. Curing can be accomplished by free-radical reaction, anionic polymerization, cationic polymerization, coordinated polymerization, or combinations thereof. If desired, curing can include exposure to a radiant light source or a heat source, such as a heating tunnel or oven, including a multi stage oven, or the like. Alternative heating sources can include exposure to infrared radiation lamps, or the like. Alternatively curing can proceed at ambient conditions.

In an embodiment, the polymer impregnated backing substrate is cured at a particular temperature or temperature range. In an embodiment, the curing temperature is in a range of at least about 20° C. to not greater than 200° C. In an embodiment, the curing temperature is in a range of at least about 20° C. to not greater than 50° C. In an embodiment, the curing temperature is in a range of at least about 90° C. to not greater than 200° C. In a particular embodiment, the curing temperature can be in the range of not less than 100° C. to not greater than about 150° C.

In accordance with an embodiment, the compressed polymer impregnated backing substrate can be cured to a particular degree (i.e., the polymeric composition saturating the backing material is cured to a particular degree). In an embodiment, the compressed polymer impregnated backing substrate can be partially cured or completely cured. In an embodiment, the compressed polymer impregnated backing substrate is fully cured. In another embodiment, the compressed polymer impregnated backing substrate is partially cured. In an embodiment, the compressed polymer impregnated backing substrate is partially cured not greater than 95%, such as not greater than 90%, not greater than 80%, not greater than 70%, not greater than 60%, not greater than 55%, or not greater than 50%. In an embodiment, the compressed polymer impregnated backing substrate is partially cured not less than 5%, such as not less than 10%, not less than 20%, not less than 30% or not less than 35%. The amount of partially curing the compressed polymer impregnated backing substrate can be within a range comprising any pair of the previous upper and lower limits. In a particular embodiment, the compressed polymer impregnated backing substrate is partially cured not greater than 95% and not less than 5%, such not greater than 60% and not less than 20%, or not greater than 50% and not less than 30%.

In another embodiment, the compressed polymer impregnated backing substrate can be cured to a degree that the surface of the partially cured backing substrate is rendered tack free (i.e., not tacky, does not stick to fingers), but the partially cured fabric is still pliable and suitable for further processing.

Partially to fully curing the compressed polymer impregnated backing substrate forms a completed compressed polymer impregnated backing substrate (i.e., a compressed composite backing material).

Preparation of a Coated Abrasive

The compressed composite backing material can be used to make a coated abrasive article. In an embodiment, an abrasive layer is disposed on the compressed composite backing material. Optionally, a size coat, a supersize coat, a back coat or any other number of compliant or intermediary layers known in the art of making a coated abrasive article can be applied to the amino or phenolic resin treated backing to construct a coated abrasive article.

Abrasive Layer

An abrasive layer can comprise a make coat or an abrasive slurry. The make coat or abrasive slurry can comprise a plurality of abrasive particles, also referred to herein as abrasive grains, retained by a polymer binder composition. The polymer binder composition can be an aqueous composition. The polymer binder composition can be a thermosetting composition, a radiation cured composition, or a combination thereof.

Abrasive Grains

Abrasive grains can include essentially single phase inorganic materials, such as alumina, silicon carbide, silica, ceria, and harder, high performance superabrasive grains such as cubic boron nitride and diamond. Additionally, the abrasive grains can include composite particulate materials. Such materials can include aggregates, which can be formed through slurry processing pathways that include removal of the liquid carrier through volatilization or evaporation, leaving behind green aggregates, optionally followed by high temperature treatment (i.e., firing) to form usable, fired aggregates. Further, the abrasive regions can include engineered abrasives including macrostructures and particular three-dimensional structures.

In an exemplary embodiment, the abrasive grains are blended with the binder formulation to form abrasive slurry. Alternatively, the abrasive grains are applied over the binder formulation after the binder formulation is coated on the backing. Optionally, a functional powder can be applied over the abrasive regions to prevent the abrasive regions from sticking to a patterning tooling. Alternatively, patterns can be formed in the abrasive regions absent the functional powder.

The abrasive grains can be formed of any one of or a combination of abrasive grains, including silica, alumina (fused or sintered), zirconia, zirconia/alumina oxides, silicon carbide, garnet, diamond, cubic boron nitride, silicon nitride, ceria, titanium dioxide, titanium diboride, boron carbide, tin oxide, tungsten carbide, titanium carbide, iron oxide, chromia, flint, emery. For example, the abrasive grains can be selected from a group consisting of silica, alumina, zirconia, silicon carbide, silicon nitride, boron nitride, garnet, diamond, co-fused alumina zirconia, ceria, titanium diboride, boron carbide, flint, emery, alumina nitride, and a blend thereof. Particular embodiments have been created by use of dense abrasive grains comprised principally of alpha-alumina.

The abrasive grain can also have a particular shape. An example of such a shape includes a rod, a triangle, a pyramid, a cone, a solid sphere, a hollow sphere, or the like. Alternatively, the abrasive grain can be randomly shaped.

In an embodiment, the abrasive grains can have an average grain size not greater than 800 microns, such as not greater than about 700 microns, not greater than 500 microns, not greater than 200 microns, or not greater than 100 microns. In another embodiment, the abrasive grain size is at least 0.1 microns, at least 0.25 microns, or at least 0.5 microns. In another embodiment, the abrasive grains size is from about 0.1 microns to about 200 microns and more typically from about 0.1 microns to about 150 microns or from about 1 micron to about 100 microns. The grain size of the abrasive grains is typically specified to be the longest dimension of the abrasive grain. Generally, there is a range distribution of grain sizes. In some instances, the grain size distribution is tightly controlled.

Binder—Make Coat or Abrasive "Slurry" Coat

The binder of the make coat or the size coat can be formed of a single polymer or a blend of polymers. For example, the binder can be formed from epoxy, acrylic polymer, or a combination thereof. In addition, the binder can include filler, such as nano-sized filler or a combination of nano-sized filler and micron-sized filler. In a particular embodiment, the binder is a colloidal binder, wherein the formulation that is cured to form the binder is a colloidal suspension including particulate filler. Alternatively, or in addition, the binder can be a nanocomposite binder including sub-micron particulate filler.

The binder generally includes a polymer matrix, which binds abrasive grains to the backing or compliant coat, if present. Typically, the binder is formed of cured binder formulation. In one exemplary embodiment, the binder formulation includes a polymer component and a dispersed phase.

The binder formulation can include one or more reaction constituents or polymer constituents for the preparation of a polymer. A polymer constituent can include a monomeric molecule, a polymeric molecule, or a combination thereof. The binder formulation can further comprise components selected from the group consisting of solvents, plasticizers, chain transfer agents, catalysts, stabilizers, dispersants, curing agents, reaction mediators and agents for influencing the fluidity of the dispersion.

The polymer constituents can form thermoplastics or thermosets. By way of example, the polymer constituents can include monomers and resins for the formation of polyurethane, polyurea, polymerized epoxy, polyester, polyimide, polysiloxanes (silicones), polymerized alkyd, styrene-butadiene rubber, acrylonitrile-butadiene rubber, polybutadiene, or, in general, reactive resins for the production of thermoset polymers. Another example includes an acrylate or a methacrylate polymer constituent. The precursor polymer constituents are typically curable organic material (i.e., a polymer monomer or material capable of polymerizing or crosslinking upon exposure to heat or other sources of energy, such as electron beam, ultraviolet light, visible light, etc., or with time upon the addition of a chemical catalyst, moisture, or other agent which cause the polymer to cure or polymerize). A precursor polymer constituent example includes a reactive constituent for the formation of an amino polymer or an aminoplast polymer, such as alkylated urea-formaldehyde polymer, melamine-formaldehyde polymer, and alkylated benzoguanamine-formaldehyde polymer; acrylate polymer including acrylate and methacrylate polymer, alkyl acrylate, acrylated epoxy, acrylated urethane, acrylated polyester, acrylated polyether, vinyl ether, acrylated oil, or acrylated silicone; alkyd polymer such as urethane alkyd polymer; polyester polymer; reactive urethane polymer; phenolic polymer such as resole and novolac polymer; phenolic/latex polymer; epoxy polymer such as bisphenol epoxy polymer; isocyanate; isocyanurate; polysiloxane polymer including alkylalkoxysilane polymer; or reactive vinyl polymer. The binder formulation can include a monomer, an oligomer, a polymer, or a combination thereof. In a particular embodiment, the binder formulation includes monomers of at least two types of polymers that when cured can crosslink. For example, the binder formulation can include epoxy constituents and acrylic constituents that when cured form an epoxy/acrylic polymer.

Size Coat

The coated abrasive article can comprise a size coat overlying the abrasive layer. The size coat can be the same as or different from the polymer binder composition used to form the abrasive layer. The size coat can comprise any conventional compositions known in the art that can be used as a size coat. In an embodiment, the size coat comprises a conventionally known composition overlying the polymer binder composition of the abrasive layer. In another embodiment, the size coat comprises the same ingredients as the polymer binder composition of the abrasive layer. In a specific embodiment, the size coat comprises the same ingredients as the polymer binder composition of the abrasive layer and one or more hydrophobic additives. In a specific embodiment, the hydrophobic additive can be a wax, a halogenated organic compound, a halogen salt, a metal, or a metal alloy.

Supersize Coat

The coated abrasive article can comprise a supersize coat overlying the size coat. The supersize coat can be the same as or different from the polymer binder composition or the size coat composition. The supersize coat can comprise any conventional compositions known in the art that can be used as a supersize coat. In an embodiment, the supersize coat comprises a conventionally known composition overlying the size coat composition. In another embodiment, the supersize coat comprises the same ingredients as at least one of the size coat composition or the polymer binder composition of the abrasive layer. In a specific embodiment, the supersize coat comprises the same composition as the polymer binder composition of the abrasive layer or the composition of the size coat plus one or more grinding aids.

Suitable grinding aids can be inorganic based; such as halide salts, for example sodium cryolite, and potassium tetrafluoroborate; or organic based, such as sodium lauryl sulphate, or chlorinated waxes, such as polyvinyl chloride. In an embodiment, the grinding aid can be an environmentally sustainable material.

Additives

Any of the various polymeric compositions used to form the compressed composite backing material; namely the polymeric composition (dip fill), and the component layers of the coated abrasive article; namely the binder (as a make coat or "slurry" coat), the size coat composition, and the supersize composition can comprise one or more additives.

Suitable additives can include grinding aids, fibers, lubricants, wetting agents, thixotropic materials, surfactants, thickening agents, pigments, dyes, antistatic agents, coupling agents, plasticizers, suspending agents, pH modifiers, adhesion promoters, lubricants, bactericides, fungicides, flame retardants, degassing agents, anti-dusting agents, dual function materials, initiators, chain transfer agents, stabilizers, dispersants, reaction mediators, colorants, and defoamers. The amounts of these additive materials can be selected to provide the properties desired. These optional additives may be present in any part of the overall system of the coated abrasive product according to embodiments of the present disclosure.

Illustrated in FIG. 2 is an embodiment of a coated abrasive article 200, commonly called a "coated abrasive."

EXAMPLES

Example 1: Making a Compressed Spunlace Fabric Impregnated with Epoxy Composition Several samples of nonwoven spunlace fabric were obtained for forming inventive abrasive articles. The nonwoven spunlace fabrics were formed of polyester. The spunlace fabric had a weight in a range of about 150 GSM and a thickness of 0.8 mm to 1.2 mm. Two layers of the spunlace fabric were laid flat on top of each other (total weight of approximately 300 GSM) and placed in an open compression mold that was filled with an epoxy polymeric composition (Araldyte® phenolic epoxy from Ciba Specialty Chemicals) to saturate the spunlace fabric. The amount of epoxy polymeric composition in the mold was adjusted to provide about 600-700 GSM of uptake of epoxy composition to the spunlace fabric.

The lid was placed on the mold and the lid spacers were adjusted so that pressure was applied to the epoxy impregnated spunlace in a range of 120 psi to 200 psi. The compressed epoxy impregnated spunlace fabric was allowed to cure a room temperature (about 20° C.) until completely cured. The completed compressed composite material was removed from the mold to be used to construct a coated abrasive disc. The completed compressed composite material had a thickness of approximately 1 mm and a weight of 1000 GSM.

Example 2: Making a Compressed Spunlace Impregnated with Phenolic Composition The procedure described above in Example 1 was repeated, except that the polymeric composition was a low temperature (LT) phenolic resole composition adjusted with water as needed to achieve a suitable viscosity. The amount of phenolic polymeric composition uptake was again about 600-700 GSM to the spunlace fabric.

The lid was placed on the mold and the lid spacers were adjusted so that pressure was applied to the phenolic impregnated spunlace in a range of 120 psi to 200 psi. The compressed phenolic impregnated spunlace fabric was cured at temperature in a range of about 150° C. to 180° C. until completely cured. The completed compressed composite material was removed from the mold to be used to construct a coated abrasive disc. The completed compressed composite material was removed from the mold to be used to construct a coated abrasive disc. The completed compressed composite material had a thickness of approximately 1 mm and a weight of 1000 GSM.

Example 3: Nonwoven Stitch Bonded Fabric Impregnated with Phenolic Composition Several samples of nonwoven stitch bonded fabric were obtained for forming inventive abrasive articles. The nonwoven stitch bonded fabrics were formed of 100% polyester interlocked web formed by a needling procedure using 0-15 mm penetration at a rate of about 10-50 stokes per unit area. The fiber of the nonwoven fabrics had fiber weight in a range of about 100 GSM to about 300 GSM (i.e., grams per square meter, or $g/m^2$) as measured after the needling procedure. Three layers of nonwoven webs were then stitched together with stitch thread, alternating cross-laid and machine-laid nonwoven webs, to form a nonwoven stitch bonded fabric. The nonwoven stitch bonded fabric had a weight of 380 GSM, and a thickness of 1.0 mm to 2.0 mm.

The procedure described above in Example 2 was repeated using the low temperature (LT) phenolic resole composition adjusted with water as needed to achieve a suitable viscosity. The amount of phenolic polymeric composition uptake was about 600 GSM to the stitch bonded fabric.

The lid was placed on the mold and the lid spacers were adjusted so that pressure was applied to the phenolic impregnated stitch bonded fabric in a range of 120 psi to 200 psi. The compressed phenolic impregnated stitch bonded fabric was cured at temperature in a range of about 150° C. to 180° C. until completely cured. The completed compressed composite material was removed from the mold to be used to construct a coated abrasive disc. The completed compressed composite material had a thickness of approximately 1 mm and a weight of 1000 GSM.

Example 4: Nonwoven Stitch Bonded Fabric Impregnated with Phenolic Composition The procedure described above in Example 3 was repeated, except that the polymeric composition was a different phenolic resole composition (BM11) having a different water tolerance, which was adjusted with water as needed to achieve a suitable viscosity. The amount of phenolic polymeric composition uptake was again about 600 GSM to the stitch bonded fabric.

The lid was placed on the mold and the lid spacers were adjusted so that pressure was applied to the phenolic impregnated spunlace in a range of 120 psi to 200 psi. The compressed phenolic impregnated spunlace fabric was cured at temperature in a range of about 150° C. to 180° C. until completely cured. The completed compressed composite material was removed from the mold to be used to construct a coated abrasive disc. The completed compressed composite material had a thickness of approximately 1 mm and a weight of 1000 GSM.

Example 5: Tensile Strength Testing

Tensile strength testing and flexural modulus testing of comparative vulcanized fiber samples and the inventive compressed composite backing material samples prepared in Examples 1-4 was conducted.

Figure 6:
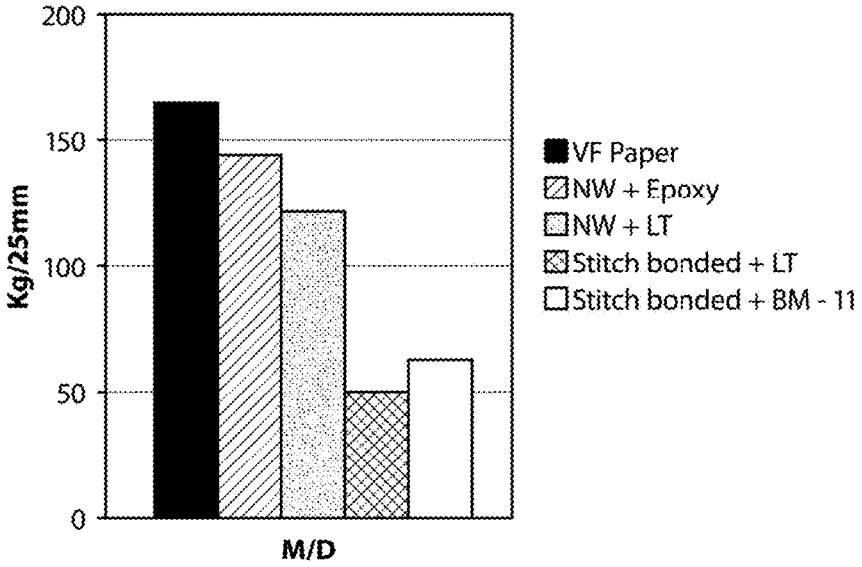
FIG. 6 is a graph comparing the tensile strength in the machine direction of embodiments of compressed composite backing material samples with conventional vulcanized fiber and paper backing materials.

Tensile strength in the machine direction (M/D) was measured using an Instron 5982 with a 2 kN load cell. The compressed composite backing material samples had a total sample length of 200 mm, a sample width of 25 mm, a gauge length of 127 mm, and were tested at a deformation rate of 300 mm/min. The results are shown in FIG. 6.

The comparative vulcanized fiber sample had a tensile strength in the machine direction of just over 160 Kgf/25 mm. The inventive spunlace samples had a tensile strength in the machine direction of slightly less than 150 Kgf/25 mm. The inventive stitch bonded samples had a tensile strength in the machine direction of less than 75 Kgf/25 mm.

Figure 7:
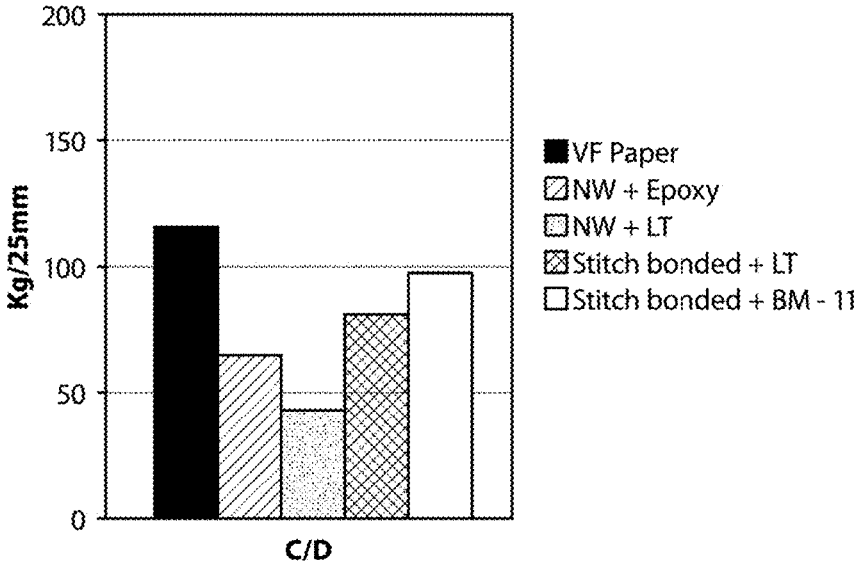
FIG. 7 is a graph comparing the tensile strength in the cross direction of embodiments of compressed composite backing material samples with conventional vulcanized fiber and paper backing materials.

Tensile strength in the machine direction (C/D) was measured using an Instron 5982 with a 2 kN load cell. The composite backing material samples had a total sample length of 200 mm, a sample width of 25 mm, a gauge length of 127 mm, and were tested at a deformation rate of 300 mm/min. The results are shown in FIG. 7.

The comparative vulcanized fiber sample had a tensile strength in the machine direction of just under 125 Kgf/25 mm. The inventive spunlace samples had a tensile strength in the cross direction of less than 60 Kgf/25 mm. The inventive stitch bonded samples had a tensile strength in the cross direction of slightly less than 100 Kgf/25 mm.

Figure 8:
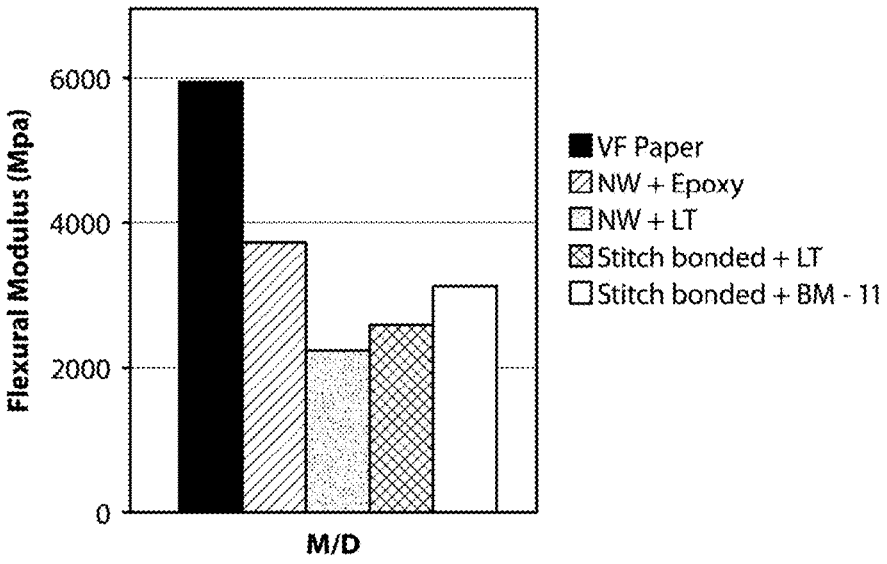
FIG. 8 is a graph comparing flexural modulus data in the machine direction of embodiments of compressed composite backing material samples with a conventional vulcanized fiber backing material.

Flexural Modulus in the machine direction (M/D) was measured using an Instron 5966 with a 10 KN load cell. The composite backing material samples had a total sample length of 10 cm, a sample width of 1 inch mm, a gauge length of 127 mm, and were tested at a deformation rate of 1 mm/min (flexural grip used: three point bending), with the test based on ASTM D-790. The results are shown in FIG. 8.

The comparative sample had a flexural modulus in the machine direction of just under 6 GPa. The inventive spunlace samples had a flexural modulus in the machine direction of slightly less than 4 GPa. The inventive stitch bonded samples had a flexural modulus in the machine direction of slightly less than 3 GPa.

Figure 9:
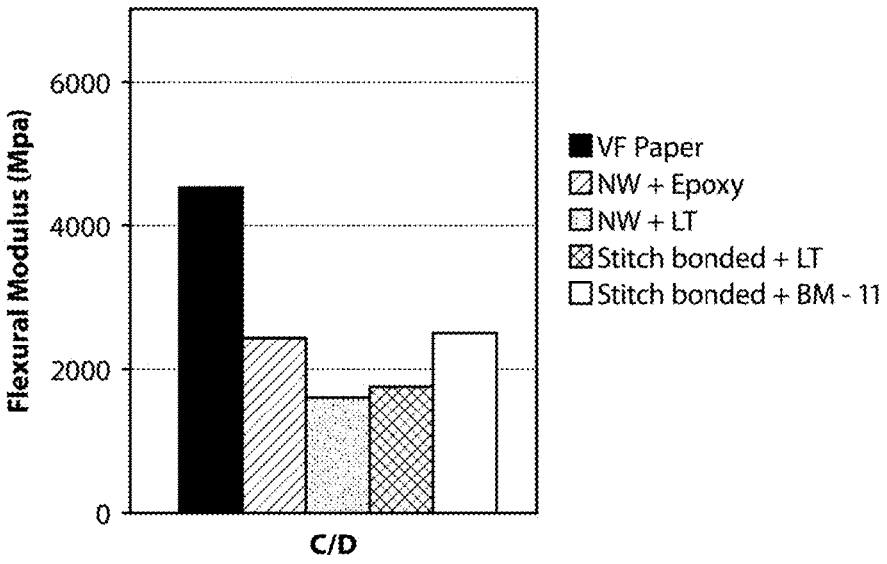
FIG. 9 is a graph comparing the flexural modulus data in the cross direction of embodiments of a compressed composite backing material samples with a conventional vulcanized fiber backing material.

Flexural Modulus in the cross direction (C/D) was measured using an Instron 5966 with a 10 KN load cell. The composite backing material samples had a total sample length of 10 cm, a sample width of 1 inch mm, a gauge length of 127 mm, and were tested at a deformation rate of 1 mm/min (flexural grip used: three point bending), with the test based on ASTM D-790. The results are shown in FIG. 9.

The comparative sample had a flexural modulus in the cross direction of just under 5 GPa. The inventive spunlace samples had a flexural modulus in the cross direction of less than 3 GPa. The inventive stitch bonded samples had a flexural modulus in the cross direction of less than 3 GPa.

Example 6: Abrasive Disc Construction

Abrasive discs (5 inch) were prepared using the compressed composite backing material samples prepared in Example 1 and Example 3. Comparative abrasive discs were prepared using conventional vulcanized fiber substrate. The only difference between the inventive and comparative abrasive discs was the compressed composite backing material.

Example 7: Grinding Testing of Abrasive Discs—Mild Steel

Figure 10:
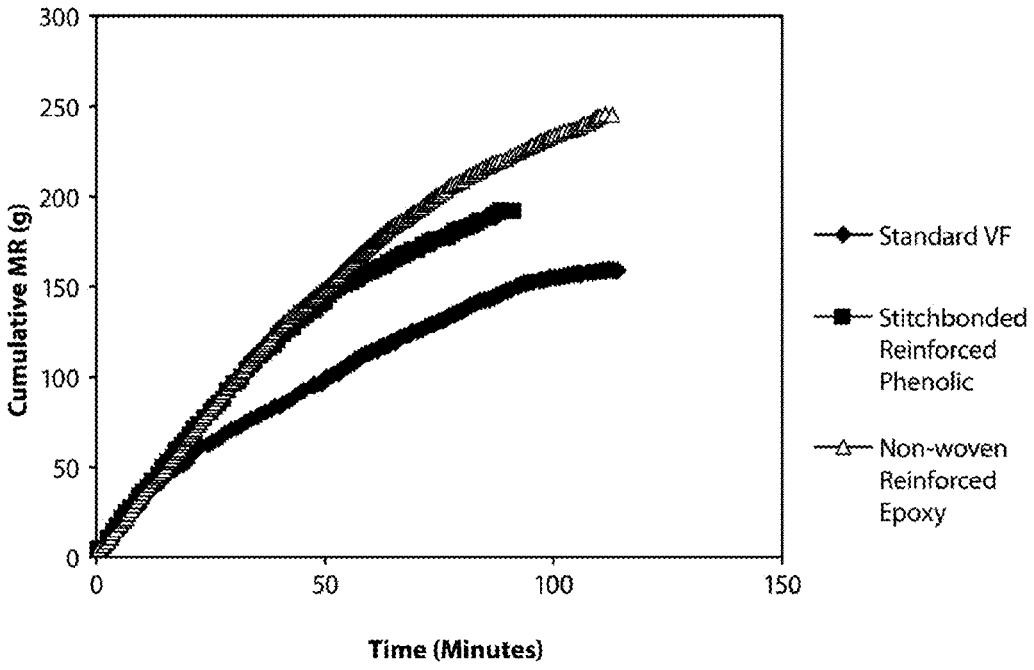
FIG. 10 is a graph showing cumulative material removed from a substrate by embodiments of coated abrasives that include compressed composite backing material samples compared to a conventional vulcanized fiber coated abrasive.

Abrasive testing of the abrasive discs prepared in Example 6 was conducted on mild steel test panels. Cumulative material removed from the test panels was measured until the product reached the end of its useful life. The results of the abrasive testing are shown in FIG. 10. As shown in FIG. 10, the inventive abrasive disc samples had a clearly higher volume of cumulative material removed ("cumulative MW") compared to the conventional vulcanized fiber discs.

It was also observed that the conventional abrasive discs reached end of life after approximately 130 minutes of use. The inventive discs were able to be used for comparable lengths of time (approximately 100 minutes and 130 minutes) before reaching end of life.

Example 8: Grinding Testing of Abrasive Discs—Stainless Steel

Abrasive testing of the abrasive discs prepared in Examples 2 and Examples 4 was conducted on stainless steel test panels. Cumulative material removed from the test panels was measured for the earlier of 20 minutes or until the product reached the end of its useful life.

Figure 11:
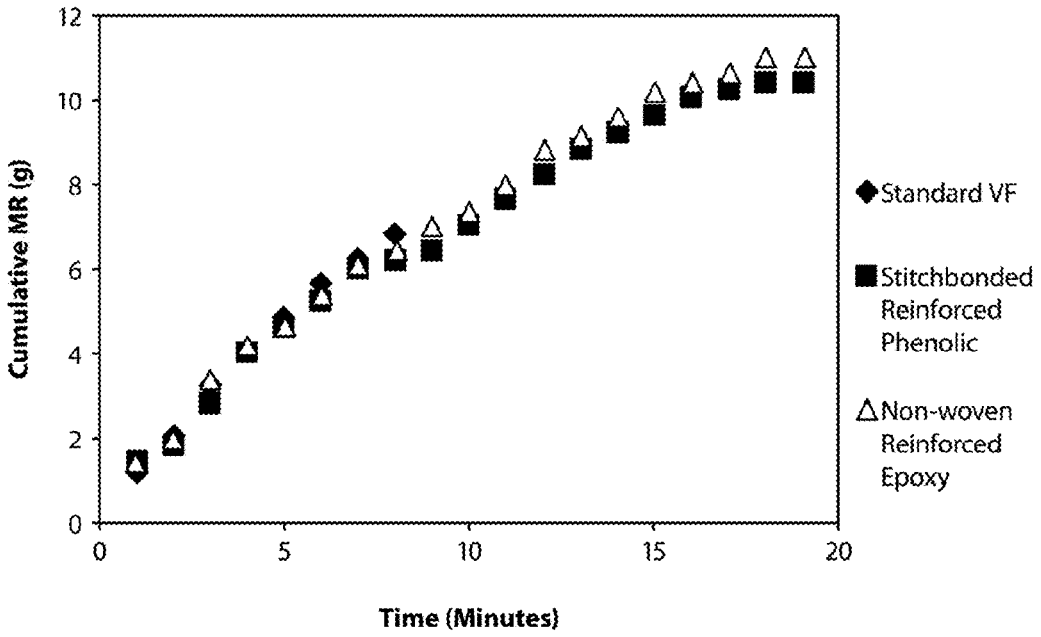
FIG. 11 is a graph showing cumulative material removed from a substrate by embodiments of coated abrasives that include compressed composite backing material samples compared to a conventional vulcanized fiber coated abrasive.

The results of the abrasive testing are shown in FIG. 11. As shown in FIG. 11, the inventive abrasive disc samples had a clearly higher volume of cumulative material removed ("cumulative MR") compared to the conventional vulcanized fiber discs.

It was also observed that the conventional abrasive disc reached end of life after approximately 8 minutes of use. The inventive discs were able to be used for much longer lengths of time (both lasted almost 20 minutes).

Example 9: Grinding Testing of Abrasive Discs—Stainless Steel

Abrasive testing of the abrasive discs prepared in Examples 1 and Examples 3 were conducted on stainless steel test panels. Cumulative material removed from the test panels was measured for the earlier of 20 minutes or until the product reached the end of its useful life.

Figure 12:
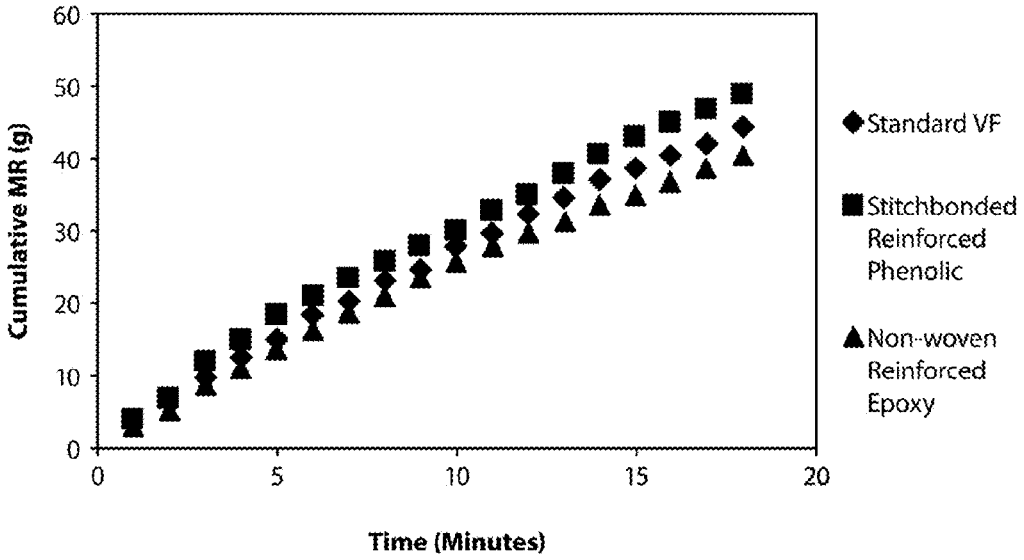
FIG. 12 is a graph showing cumulative material removed from a substrate by embodiments of coated abrasives that include compressed composite backing material samples compared to a conventional vulcanized fiber coated abrasive.

The results of the abrasive testing are shown in FIG. 12. As shown in FIG. 12, the inventive abrasive disc samples had a comparable volume of cumulative material removed ("cumulative MW") compared to the conventional vulcanized fiber discs.

It was also observed that the conventional abrasive disc and the inventive discs all lasted for the duration of the test (approximately 20 minutes).

Example 10: Dimensional Stability Testing—35° C. and 85% Relative Humidity

Inventive coated abrasive discs and comparative vulcanized fiber abrasive discs as prepared in Example 6 were subjected to dimensional stability testing to measure weight gain and dimensional distortion of the abrasive discs. The only difference between the inventive and comparative abrasive discs was the compressed composite backing material.

Figure 13A:
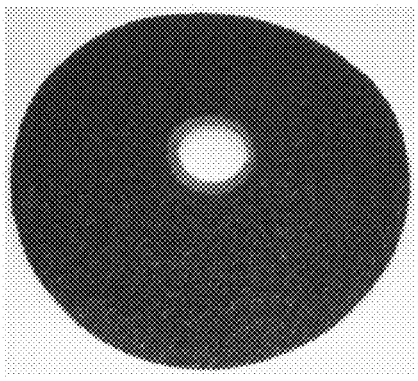
FIG. 13A is a photograph of a conventional vulcanized fiber abrasive disc prior to dimensional stability testing at a temperature of 35° C. and 85% relative humidity.
Figure 13B:
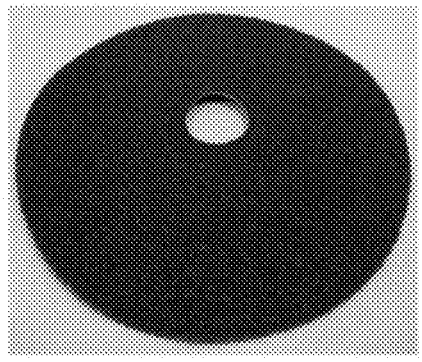
FIG. 13B is a photograph of a conventional vulcanized fiber abrasive disc after dimensional stability testing at a temperature of 35° C. and 85% relative humidity.
Figure 14A:
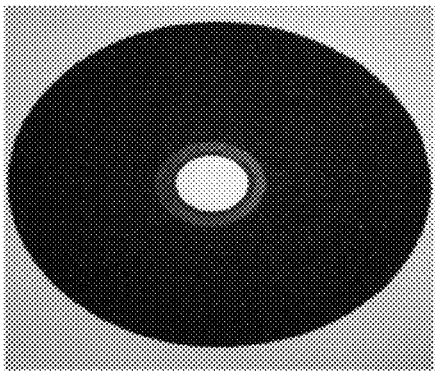
FIG. 14A is a photograph of an inventive abrasive disc embodiment prior to dimensional stability testing at a temperature of 35° C. and 85% relative humidity.
Figure 14B:
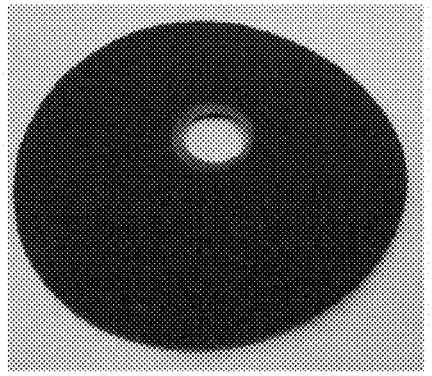
FIG. 14B is a photograph of an inventive abrasive disc embodiment after dimensional stability testing at a temperature of 35° C. and 85% relative humidity.
Figure 15A:
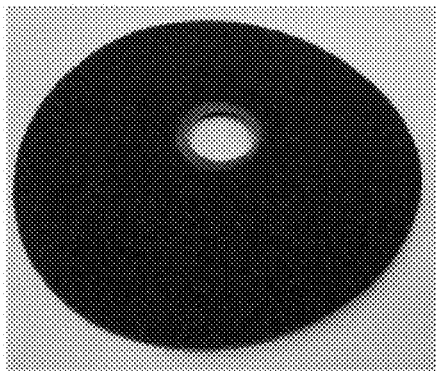
FIG. 15A is a photograph of another inventive abrasive disc embodiment prior to dimensional stability testing at a temperature of 35° C. and 85% relative humidity.
Figure 15B:
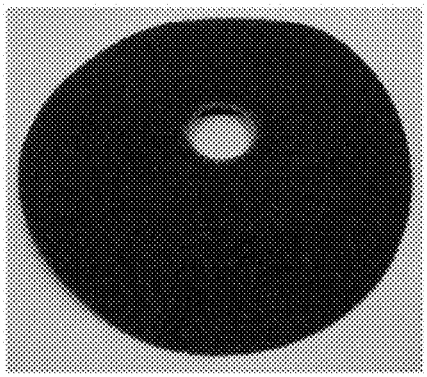
FIG. 15B is a photograph of another inventive abrasive disc embodiment after dimensional stability testing at a temperature of 35° C. and 85% relative humidity.

The inventive and comparative discs were placed in a climate chamber set to 35° C. and 85% relative humidity for 2.5 hours. FIG. 13A (comparative sample) and FIG. 14A and FIG. 15A (inventive samples) show the samples prior to being placed in the climate chamber. FIG. 13B (comparative sample) and FIG. 14B and FIG. 15B (inventive samples) show the samples after having been placed in the climate chamber for a fixed amount of time.

Figure 16:
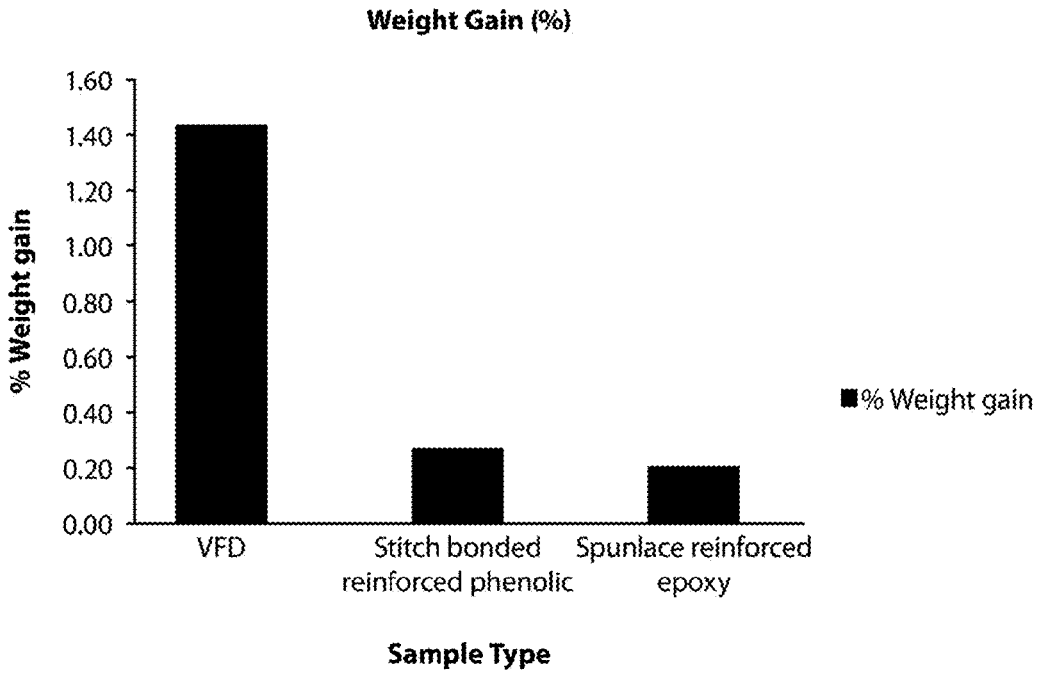
FIG. 16 is a bar graph comparing the % weight gained by the conventional abrasive disc and the inventive abrasive disc embodiments shown in FIGS. 13A-15B due to dimensional stability testing at a temperature of 35° C. and 85% relative humidity.

The % weight gained is shown in FIG. 16. As can be seen the conventional sample gained slightly greater than 1.4% weight. The inventive samples gained less than 0.3% weight.

Figure 17:
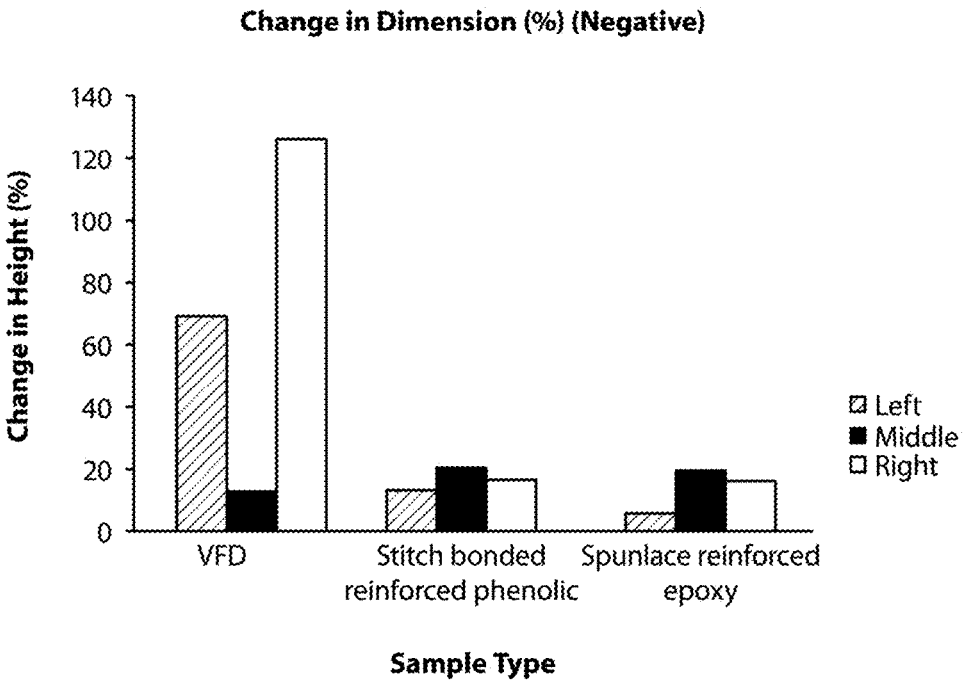
FIG. 17 is a graph showing the % change in dimensions of the conventional abrasive disc and the inventive abrasive disc embodiments shown in FIGS. 13A-15B due to dimensional stability testing at a temperature of 35° C. and 85% relative humidity.

The change in disc dimensions is shown in FIG. 17. The change in disc dimensions was recorded by selecting three points along the center line of the abrasive disc, point "L" at the left edge of the disc, point "M" at the middle of the disc along the edge of the center hole of the disc, and point "R" at the right edge of the disc. As can be seen, the conventional sample had change in dimension that varied from a high of slightly below 130% to a low of just under 15%, indicating very appreciable edge distortion. The inventive samples dimensional distortion ranged from a high of approximately 21% to less than 7%, indicating significant dimensional stability.

In the foregoing, reference to specific embodiments and the connections of certain components is illustrative. It will be appreciated that reference to components as being coupled or connected is intended to disclose either direct connection between said components or indirect connection through one or more intervening components as will be appreciated to carry out the methods as discussed herein. As such, the above-disclosed subject matter is to be considered illustrative, and not restrictive, and the appended claims are intended to cover all such modifications, enhancements, and other embodiments, which fall within the true scope of the present invention. Moreover, not all of the activities described above in the general description or the examples are required, that a portion of a specific activity can not be required, and that one or more further activities can be performed in addition to those described. Still further, the order in which activities are listed is not necessarily the order in which they are performed.

The disclosure is submitted with the understanding that it will not be used to limit the scope or meaning of the claims. In addition, in the foregoing disclosure, certain features that are, for clarity, described herein in the context of separate embodiments, can also be provided in combination in a single embodiment. Conversely, various features that are, for brevity, described in the context of a single embodiment, can also be provided separately or in any subcombination. Still, inventive subject matter can be directed to less than all features of any of the disclosed embodiments.

Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, or essential feature of any or all the claims.

Thus, to the maximum extent allowed by law, the scope of the present invention is to be determined by the broadest permissible interpretation of the following claims and their equivalents, and shall not be restricted or limited by the foregoing detailed description.

Embodiment 1

A compressed composite backing material comprising: a compressed backing substrate impregnated with a polymeric composition, wherein the polymeric composition comprises an epoxy composition, a phenolic composition, or combinations and blends thereof.

Embodiment 2

The compressed composite backing material of embodiment 1, wherein the compressed backing substrate comprises a nonwoven fabric, a woven fabric, a paper, a paper reinforced with fibre, or combinations thereof.

Embodiment 3

The compressed backing material of embodiment 2, wherein the compressed backing material is a nonwoven fabric.

Embodiment 4

The compressed composite backing material of embodiment 1, wherein the polymeric composition comprises an epoxy composition.

Embodiment 5

The compressed composite backing material of embodiment 4, wherein the epoxy composition comprises a Bisphenol A resin, a Bisphenol F resin, a phenolic novolac resin, or a combination thereof.

Embodiment 6

The compressed composite backing material of embodiment 4, wherein the epoxy composition comprises a polyamide, an amidoamine, a phenalkamine, a cycloaliphatic amine, an aromatic amine, and aliphatic amine adduct, an aliphatic amine, or combinations thereof.

Embodiment 7

The compressed composite backing material of embodiment 4, wherein the epoxy composition comprises an amine epoxy, a polyamide epoxy, an amidoamine epoxy, a phenolic novolac epoxy, or combinations thereof.

Embodiment 8

The compressed composite backing material of embodiment 4, wherein the polymeric composition comprises at least 50% epoxy composition, at least 60% epoxy composition, at least 70% epoxy composition, at least 80% epoxy composition, at least 90% epoxy composition, at least 95% epoxy composition, at least 99% epoxy composition, or about 100% epoxy composition.

Embodiment 9

The compressed composite backing material of embodiment 1, wherein the polymeric composition comprises a phenolic resole composition.

Embodiment 10

The compressed composite backing material of embodiment 9, wherein the phenolic resole composition comprises a first phenolic resole resin.

Embodiment 11

The compressed composite backing material of embodiment 10, wherein the phenolic resole composition further comprises a second phenolic resole resin.

Embodiment 12

The compressed composite backing material of embodiment 10, wherein the first phenolic resole resin comprises a formaldehyde to phenol ratio (F/P ratio) in a range of 0.95 to 2.5.

Embodiment 13

The compressed composite backing material of embodiment 10, wherein the first phenolic resole resin comprises a gel time at 121° C. in range of 5 minutes to 30 minutes.

Embodiment 14

The compressed composite backing material of embodiment 10, wherein the first phenolic resole resin comprises a water tolerance in a range of 100% to 600%.

Embodiment 15

The compressed composite backing material of embodiment 10, wherein the first phenolic resole resin comprises an F/P ratio in a range of 1.6 to 1.8, a gel time at 121° C. in a range of 8-12 minutes; and a water tolerance in a range of 430 to 500%.

Embodiment 16

The compressed composite backing material of embodiment 11, wherein the second phenolic resole resin comprises a formaldehyde to phenol ratio (F/P ratio) in a range of 0.95 to 2.5.

Embodiment 17

The compressed composite backing material of embodiment 11, wherein the second phenolic resole resin comprises a gel time at 121° C. in range of 5 minutes to 30 minutes.

Embodiment 18

The compressed composite backing material of embodiment 11, wherein the second phenolic resole resin comprises a water tolerance in a range of 100% to 600%.

Embodiment 19

The compressed composite backing material of embodiment 11, wherein the second phenolic resole resin comprises an F/P ratio in a range of 1.6 to 1.8, a gel time at 121° C. in a range of 8-12 minutes; and a water tolerance in a range of 400 to 480%.

Embodiment 20

The compressed composite backing material of embodiment 11, wherein the first phenolic resole resin and the second phenolic resole resin are present in a ratio (first resin:second resin) ranging from 1:9 to 9:1, such as from 1:2 to 2:1; from 1:1.5 to 1.5:1; from 1:1.25 to 1.25:1; or about 1:1.

Embodiment 21

The compressed composite backing material of embodiment 1, wherein the polymeric composition is uniformly dispersed throughout the backing substrate.

Embodiment 22

The compressed composite backing material of embodiment 1, wherein the amount of the polymeric composition comprises 200 g/m$^2$ to 1000 g/m$^2$; about 250 g/m$^2$ to 600 g/m$^2$; about 300 g/m$^2$ to 550 g/m$^2$; or about 400 g/m$^2$ to 500 g/m$^2$.

Embodiment 23

The compressed composite backing material of embodiment 1, wherein the polymeric composition further comprises a filler.

Embodiment 24

The compressed composite backing material of embodiment 1, wherein the polymeric composition further comprises a thickener.

Embodiment 25

The compressed composite backing material of embodiment 3, wherein the nonwoven fabric is a spun lace fabric, a chemically bonded fabric, a thermally bonded fabric, a needle punched fabric, a stitch bonded fabric, or a combination thereof.

Embodiment 26

The compressed composite backing material of embodiment 25, wherein the nonwoven fabric is a spun lace fabric, a stitch bonded fabric, or a combination thereof.

Embodiment 27

The compressed composite backing material of embodiment 25, wherein the nonwoven fabric is a spun lace fabric, wherein the spunlace fabric can comprise a plurality of layers, such as 1 to 4 layers, wherein each of the spunlace layers can have a weight of 50 GSM to 200 GSM, wherein the total weight of the spunlace fabric can be in a range from 50 to 600 GSM.

Embodiment 28

The compressed composite backing material of embodiment 25, wherein the nonwoven fabric is a stitch bonded fabric, wherein the stitch bonded fabric can comprise a plurality of layers, such as 1 to 4 layers, wherein each of the stitch bonded layers can have a weight of 50 GSM to 400 GSM, wherein the total weight of the stitch bonded fabric can be in a range from 50 to 1600 GSM.

Embodiment 29

The compressed composite backing material of embodiment 28, wherein the stitch bonded fabric comprises a warp stitch bonded fabric, a weft stitch bonded fabric, or a combination thereof.

Embodiment 30

The compressed composite backing material of embodiment 28, wherein the nonwoven fabric comprises a plurality of webs.

Embodiment 31

The compressed composite backing material of embodiment 30, wherein the plurality of webs comprises a cross-laid web disposed on a machine laid web.

Embodiment 32

The compressed composite backing material of embodiment –30, wherein the plurality of webs comprises at least 2 webs and not greater than 10 webs.

Embodiment 33

The compressed composite backing material of embodiment 28, wherein the nonwoven fabric has a total weight in a range of at least 50 grams per square meter (GSM) and not greater than 600 GSM; such as about 100 GSM to 500 GSM; about 200 GSM to 400 GSM; about 300 GSM to 390 GSM.

Embodiment 34

The compressed composite backing material of embodiment 30, wherein each web of the nonwoven fabric has a weight in a range of at least 50 grams per square meter (GSM) and not greater than 300 GSM; such as about 50 GSM to 250 GSM; about 100 GSM to 200 GSM; about 125 GSM to 175 GSM.

Embodiment 35

The compressed composite backing material of embodiment 28, wherein the nonwoven fabric comprises cotton, polyester, nylon, jute, aramide, viscose, or combinations thereof.

Embodiment 36

The compressed composite backing material of embodiment 35, wherein the nonwoven fabric comprises virgin fibers, recycled fibers, or a combination thereof.

Embodiment 37

The compressed composite backing material of embodiment 35, wherein the nonwoven fabric includes an anti-static agent.

Embodiment 38

The compressed composite backing material of embodiment 28, wherein the stitch bonded fabric comprises a maliwatt fabric, a malivies fabric, a malimo fabric, a malipol fabric, a voltex fabric, a kunit fabric, a multiknit fabric, or combinations thereof.

Embodiment 39

The compressed composite backing material of embodiment 1, wherein the compressed composite backing material has a tensile strength in the machine direction in a range of not less than 1 Kg/25 mm and not greater than 150 Kg/25 mm.

Embodiment 40

The compressed composite backing material of embodiment 39, wherein the compressed composite backing material has a tensile strength in the cross direction in a range of not less than 1 Kg/25 mm and not greater than 100 Kg/25 mm.

Embodiment 41

The compressed composite backing material of embodiment 39, wherein the backing substrate has a tensile strength in the machine direction and in the cross direction of not less than 10 Kg/25 mm.

Embodiment 42

The compressed composite backing material of embodiment 1, wherein the ratio of the weight of the backing substrate to the weight of the polymeric composition is in a ratio ($Weight_{backsub}$:$Weight_{polycom}$) in a range from 1:9 to 9:1, such as from 1:2 to 2:1; from 1:1.5 to 1.5:1; from 1:1.25 to 1.25:1; or about 1:1.

Embodiment 43

The compressed composite backing material of embodiment 1 having a total thickness in a range from 0.5 mm to 5 mm.

Embodiment 44

The compressed composite backing material of embodiment 1, wherein the compressed composite backing material has a greater tensile strength in the machine direction than in the cross direction.

Embodiment 45

The compressed composite backing material of embodiment 1, wherein the compressed composite backing material has a greater tensile strength in the cross direction than in the machine direction.

Embodiment 46

The compressed composite backing material of embodiment 1, wherein the compressed composite backing material has a flexural modulus in the machine direction in a range of 1 GPa to 7 GPa.

Embodiment 47

The compressed composite backing material of embodiment 1, wherein the backing material has a flexural modulus in the cross direction in a range of 0.5 GPa to 5 GPa.

Embodiment 48

A coated abrasive article comprising: a compressed composite backing material; and an abrasive layer disposed on the compressed composite backing material.

Embodiment 49

The abrasive article of embodiment 48, wherein the compressed composite backing material comprises: a compressed backing substrate that is impregnated with a polymeric composition, wherein the polymeric composition comprises an epoxy composition, a phenolic composition, or combinations thereof.

Embodiment 50

The abrasive article of embodiment 49, wherein the backing substrate is a spunlace fabric, a stitch bonded fabric, or a combination thereof.

Embodiment 51

The abrasive article of embodiment 50, wherein the abrasive layer comprises a binder composition and abrasive particles disposed on or in the binder composition.

Embodiment 52

The abrasive article embodiment 51, wherein the binder composition comprises a polymeric binder composition.

Embodiment 53

The abrasive article of embodiment 51, wherein the abrasive layer comprises abrasive particles disposed on the binder composition.

Embodiment 54

The abrasive article of embodiment 51, wherein the abrasive layer comprises abrasive particles dispersed in the binder composition.

Embodiment 55

The abrasive article of embodiment 51, further comprising a size coat disposed over the abrasive layer.

Embodiment 56

The abrasive article of embodiment 55, further comprising a super size coat disposed over the size coat.

Embodiment 57

The abrasive article of embodiment 51, wherein the abrasive article has a mild steel material cut rating of at least 150 grams in 50 minutes.

Embodiment 58

The abrasive article of embodiment 51, wherein the abrasive article has a stainless steel material cut rating of at least 8 grams in 10 minutes.

Embodiment 59

The abrasive article of embodiment 51, wherein the abrasive article has a stainless steel test lifetime of at least 10 minutes.

Embodiment 60

The abrasive article of embodiment 51, wherein the abrasive article has an improved abrasive performance (Mass Ground) of at least 20% compared to a conventional abrasive article, wherein the only difference between the abrasive article and comparative abrasive article is that the backing material of the comparative abrasive article is vulcanized fiber.

Embodiment 61

The abrasive article of embodiment 51, wherein when the abrasive article is placed in a climate chamber at a temperature of 35° C. and 85% relative humidity (RH) for 2.5 hours has a % weight gain of less than 1.4 wt %, such as less than 1.3 wt %, less than less than 1.2 wt %, less than 1.1 wt %, or even less than 1.0 wt %.

Embodiment 62

The abrasive article of embodiment 51, wherein when the abrasive article is placed in a climate chamber at a temperature of 35° C. and 85% relative humidity (RH) for 2.5 hours has a three-point dimensional stability where all three points have a % change in dimension of less than 120%, such as less than 110%, less than 100%, less than 90%, less than 80%, less than 70%, less than 60%, less than 50%, less than 40%, less than 30%, less than 25%, or even less than 22%.

Embodiment 63

The abrasive article of embodiment 51, wherein the abrasive article is in the form of a belt, a sheet, a disc, a plurality of flaps, or a combination thereof.

Embodiment 64

The abrasive article of embodiment 63, wherein the disc shape can be round, a regular polygon, an irregular polygon, a rosette, or combinations thereof.

Embodiment 65

The abrasive article of embodiment 63, wherein the disc or sheet further comprises a hook and loop attachment system or a pressure sensitive adhesive attachment system, or a combination thereof.

Embodiment 66

The abrasive article of embodiment 63, wherein the belt is a file belt, a portable belt, a Narrow belt (less than 300 mm wide), a Wide belt (at least 300 mm wide), or combinations thereof.

Embodiment 67

The coated abrasive of embodiment 56, wherein the supersize coat comprises a stearate.

Embodiment 68

A method of making a compressed composite backing material comprising: impregnating a backing substrate with a polymeric composition to form a polymer impregnated backing substrate; compressing the polymer impregnated backing substrate by applying pressure; and curing, at least partially, the polymer impregnated backing substrate while pressing the polymer impregnated backing substrate to form a compressed composite backing material.

Embodiment 69

The method of embodiment 68, wherein the compressing step is accomplished by compressing the polymer impregnated backing substrate in a mold, a hydraulic press, rollers, or a combination thereof.

Embodiment 70

The method of embodiment 68, wherein the backing substrate is a spunlace fabric, a stitch bonded fabric, or a combination thereof.

Embodiment 71

The method of embodiment 68, wherein during the pressing step the pressure is in a range of at least 25 $lb/m^2$ to not greater than 500 $lb/m^2$.

Embodiment 72

The method of embodiment 68, wherein during the impregnating step the amount of polymeric composition impregnated into the fabric is in a range of at least 50 $g/m^2$ to not greater than 1000 $g/m^2$.

Embodiment 73

The method of embodiment 68, wherein the pressing step and the curing step are accomplished by disposing the polymer impregnated fabric in a mold, in a press, in between rollers, or a combination thereof.

Embodiment 74

The method of embodiment 68, wherein during the curing step the curing temperature is in a range of not less than 20 degrees centigrade to not greater than 200 degrees centigrade.

Embodiment 75

The method of embodiment 74, wherein the curing temperature is in a range of 20° C. to 50° C.

Embodiment 76

The method of embodiment 74, wherein the curing temperature is in a range of 90° C. to 200° C.

Embodiment 77

A method of making an abrasive article, comprising: disposing an abrasive layer on the compressed composite backing material formed according to embodiment 68.

What is claimed is:

1. An abrasive article comprising:

a compressed composite backing material comprising a compressed backing substrate impregnated with a polymeric composition, wherein the polymeric composition comprises and epoxy composition, a phenolic composition, or a combination thereof, and wherein the compressed composite backing substrate comprises a spun lace fabric having a total weight within a range from 50 to 600 grams per meter squared; and an abrasive layer disposed on the compressed composite backing material.

2. The abrasive article of claim 1, wherein the polymeric composition comprises an epoxy composition.

3. The abrasive article of claim 1, wherein the polymeric composition comprises a phenolic resole composition.

4. The abrasive article of claim 3, wherein the phenolic resole composition comprises a first phenolic resole resin.

5. The abrasive article of claim 4, wherein the phenolic resole composition further comprises a second phenolic resole resin.

6. The abrasive article of claim 4, wherein the first phenolic resole resin comprises a formaldehyde to phenol ratio in a range of 1.6 to 1.8, a gel time at 121° C. in a range of 8-12 minutes; and a water tolerance in a range of 430 to 500%.

7. The abrasive article of claim 5, wherein the second phenolic resole resin comprises a formaldehyde to phenol ratio in a range of 1.6 to 1.8, a gel time at 121° C. in a range of 8-12 minutes; and a water tolerance in a range of 400 to 480%.

8. The abrasive article of claim 1, wherein the amount of the polymeric composition comprises 200 $g/m^2$ to 1000 $g/m^2$.

9. The abrasive article of claim 1, wherein the compressed composite backing material has a tensile strength in a machine direction in a range of not less than 1 kgf/25 mm and not greater than 150 kgf/25 mm and a tensile strength in a cross direction in a range of not less than 1 kgf/25 mm and not greater than 100 kgf/25 mm.

10. The abrasive article of claim 9, wherein the compressed composite backing material has a tensile strength in the machine direction and in the cross direction of not less than 10 kgf/25 mm.

11. The abrasive article of claim 1, wherein the compressed composite backing material has a total thickness in a range from 0.5 mm to 5 mm.

12. The abrasive article of claim 1, wherein the compressed composite backing material has a flexural modulus in a machine direction in a range of 1 GPa to 7 GPa and a flexural modulus in a cross direction in a range of 0.5 GPa to 5 GPa.

13. The abrasive article of claim 1, wherein when the abrasive article is placed in a climate chamber at a temperature of 35° C. and 85% relative humidity (RH) for 2.5 hours has a % weight gain of less than 1.4 wt %.

14. The abrasive article of claim 1, wherein when the abrasive article is placed in a climate chamber at a temperature of 35° C. and 85% relative humidity (RH) for 2.5 hours has a three-point dimensional stability where all three points have a % change in dimension of less than 120%.

15. An abrasive article comprising:

a compressed composite backing material comprising a compressed backing substrate impregnated with a polymeric composition, wherein the polymeric composition comprises a first phenolic resole resin and a second phenolic resole resin, and an abrasive layer disposed on the compressed composite backing material.

16. The abrasive article of claim 15, wherein the compressed backing substrate comprises a nonwoven fabric, and wherein the nonwoven fabric is a spun lace fabric, a stitch bonded fabric, or a combination thereof.

17. The abrasive article of claim 16, wherein the nonwoven fabric is a stitch bonded fabric comprising at least 2 webs and not greater than 10 webs.

18. The abrasive article of claim 17, wherein the stitch bonded fabric has a total weight in a range from 50 to 1600 grams per meter.

* * * * *